US010457367B2

(12) United States Patent
Owen, III et al.

(10) Patent No.: US 10,457,367 B2
(45) Date of Patent: Oct. 29, 2019

(54) LATERAL THRUST DEVICE

(71) Applicants: Miller W. Owen, III, Panama City, FL (US); Thomas W. Watts, Panama City, FL (US)

(72) Inventors: Miller W. Owen, III, Panama City, FL (US); Thomas W. Watts, Panama City, FL (US)

( * ) Notice: Subject to any disclaimer, the term of this patent is extended or adjusted under 35 U.S.C. 154(b) by 0 days.

(21) Appl. No.: 16/103,235

(22) Filed: Aug. 14, 2018

(65) Prior Publication Data

US 2019/0077493 A1 Mar. 14, 2019

Related U.S. Application Data

(60) Provisional application No. 62/545,227, filed on Aug. 14, 2017.

(51) Int. Cl.
*B63H 11/11* (2006.01)
*B63H 11/08* (2006.01)

(52) U.S. Cl.
CPC ..... *B63H 11/11* (2013.01); *B63H 11/08* (2013.01); *B63H 2011/081* (2013.01)

(58) Field of Classification Search
CPC ..... B63H 11/00; B63H 11/11; B63H 11/113
USPC ..... 440/38, 41, 42
See application file for complete search history.

(56) References Cited

U.S. PATENT DOCUMENTS 4,223,630 A * 9/1980 Keeney ..... B63H 11/11 440/41
6,428,370 B1 * 8/2002 Jones ..... B63H 11/11 440/41
6,652,332 B1 * 11/2003 Westhoff ..... B63H 11/11 440/41
10,239,596 B2 * 3/2019 Owen, III ..... B63H 11/11

* cited by examiner

*Primary Examiner* — Lars A Olson
(74) *Attorney, Agent, or Firm* — Adrienne Love

(57) ABSTRACT

A device for redirecting a portion of the reverse flow of a jet stream created by a watercraft to provide a lateral thrust. The main body of device is fixed to the watercraft and includes two intersecting channels disposed therein. Each channel has a bend that and fluidly connects an inlet to an outlet. The reverse flow enters the respective inlet in a downward and backward direction with respect to main body. The respective inlet and channel of main body bend the reverse flow such that, when the reverse flow exits the outlet, the reverse flow is primarily lateral.

19 Claims, 26 Drawing Sheets

LATERAL THRUST DEVICE

CROSS-REFERENCES TO RELATED APPLICATIONS

Pursuant to the provisions of 37 C.F.R. § 1.53(c), this non-provisional application claims the benefit of an earlier-filed provisional patent application. The earlier application was assigned U.S. Ser. No. 62/545,227. It lists the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices made for propelling watercraft. More specifically, the invention relates to a mechanism for redirecting a portion of the reverse flow of a jet stream created by a water-craft having one engine.

2. Description of the Related Art

A water-jet driven craft's primary means of steering is achieved by directing the flow of water through the thrust of the water jet propulsion system. Water jet propulsion vessels are popular for recreational watercrafts. A prior art water-craft 30 is illustrated in FIG. 1. These crafts are typically propelled by two or four stroke gasoline engines in connection with an impeller housed in a tabular chamber, the forward end of which draws in the water and the rearward end which expels it to provide thrust via the jet stream 40 in order to propel the craft or vessel. In most instances, a tubular nozzle (deflector nozzle 34) is attached to the discharge end (nozzle 35) which pivots from side to side in sync with the steering control 36 to provide steering capability.

A detailed view of a prior art jet propulsion system is shown in FIG. 2. The pump assembly 28 includes the tubular chamber (impeller housing 27) and the impeller duct 26, which draws in the water. The watercraft moves forward by expelling water out of first nozzle outlet 38 of deflector nozzle 34. The deflector nozzle 34 pivots in sync with the steering control 36 allowing the forward steering of the watercraft. As shown in FIG. 3, a reverse gate 32 is pivotably attached to deflector nozzle 34. Deflector nozzle 34 has a first nozzle outlet 38 and a second nozzle outlet 42. When reverse gate 32 is in an open position (as shown in FIGS. 2 and 3) jet stream expels water out of first nozzle outlet 38. When reverse gate 32 is a closed position (as shown in FIG. 5) jet stream is redirected out of second nozzle outlet 42. As shown in FIG. 5, in a closed position reverse gate 32 diverts jet stream downward and slightly towards the back of the boat to allow the boat to slow, stop and/or drive the boat in reverse.

Currently, a watercraft has a limited turning radius when driven in reverse. When the deflector nozzle 34 is pivoted as far to the port side of the vessel as possible, the diverted jet stream is providing approximately 30 degrees of off plane steering to the vessel (as shown in FIG. 17A. The same is true in the opposite direction. Therefore, they are difficult to maneuver in small areas or around obstacles. Additionally, when a watercraft is moving in one direction, it is difficult to efficiently turn in the opposite direction. The bow of the watercraft tends to maintain the drift of the watercraft in the direction in which it is already moving. Therefore, to turn the watercraft, the force acting on the bow must be overpowered.

Prior art steering systems attempted to solve this problem by developing reverse gates that can drastically redirect the jet flow. The directional reverse gates are horizontally situated (independent of the steerable nozzle) and only pivot about the horizontal axis. When the reverse gate is closed, covering the steerable nozzle, the water is drastically redirected in the direction that the steerable nozzle faces.

The prior art systems are not entirely effective. The drastic redirection of the entire water flow causes the boat to lurch to one side or the other. The force of the lateral thrust on the craft can be abrupt and forceful because the entirety of the flow is being redirected to one side or the other. Additionally, because the water flow is forced to the side of the boat that the deflector nozzles faces, the stern travels in the opposite direction of the steering (when in reverse). Thus, the steering is counter-intuitive.

What is needed is a device which can increase control of the vessel when traveling in reverse, without sacrificing the ease of use which deflector nozzle's reverse configuration provides. The present invention achieves this objective by prowling sufficient lateral thrust to steer the craft in a controlled manner, and intuitively do so, much like automobiles and outboard powered craft. It is important to note that most boat operators will have years of automobile driving experience when they first operate a boat. Boat operators will find driving in reverse natural and intuitive with the present invention installed on the craft.

BRIEF SUMMARY OF THE INVENTION

A device for redirecting a portion of the reverse flow of a jet stream created by a watercraft to provide a lateral thrust. The main body of device is fixed to the watercraft and includes two overlapping channels disposed therein. Each channel has a curve (turn or bend) that is partially defined by an outer wall and two pivoting gates. The first channel fluidly connects a first inlet to a first outlet and the second channel timidly connects a second inlet to a second outlet. The reverse flow enters inlet in a downward and backward direction with respect to main body. The inlets and the channel of main body bend the reverse flow such that when the reverse flow exits the outlet the reverse flow is primarily lateral.

The main body of the device is fixed to the watercraft such that the inlets are beneath the deflector nozzle and are configured to accept a portion of the reverse flow, providing lateral thrust, as the deflector nozzle pivots to one side or the other of the watercraft. As the deflector nozzle pivots the area of either the first or second inlet exposed to the reverse flow increases slowly until the deflector nozzle has reached its maximum turn radius. At the maximum turn radius, the full area of at least one of the inlets is available to redirect reverse flow.

The reverse flow is typically 30 degrees from the center plane of the watercraft. Therefore, redirection of the reverse flow provides greater angular deflection for a portion of the flow. As the user steers in reverse, the device provides lateral thrust mid greater control over steering.

REFERENCE NUMERALS IN THE DRAWINGS

Figure 1:
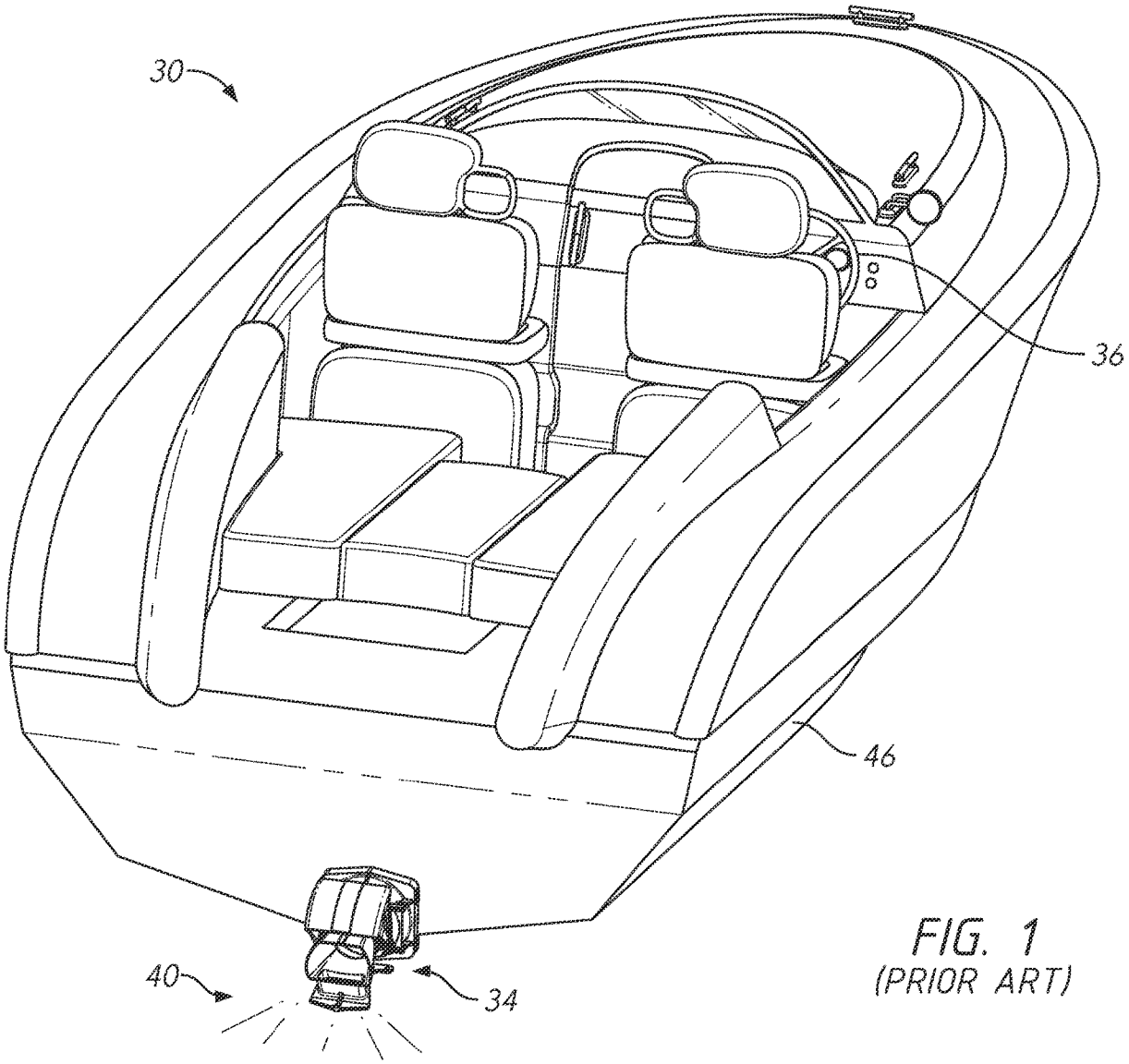
FIG. 1 (PRIOR ART)
FIG. 1 is a perspective view, showing a prior art watercraft.
Figure 2:
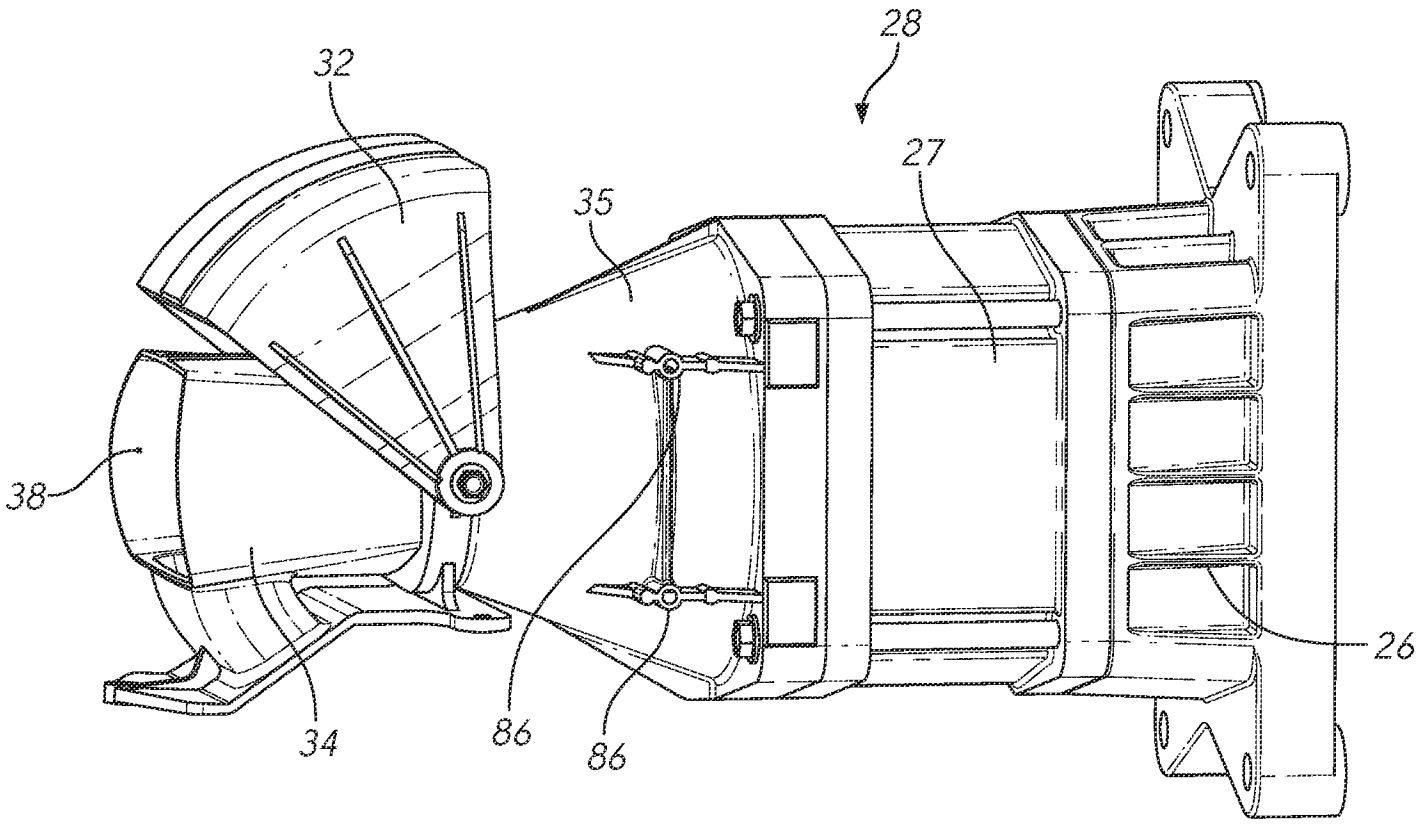
FIG. 2 (PRIOR ART)
FIG. 2 is a perspective view, showing a prior art jet propulsion system.
Figure 3:
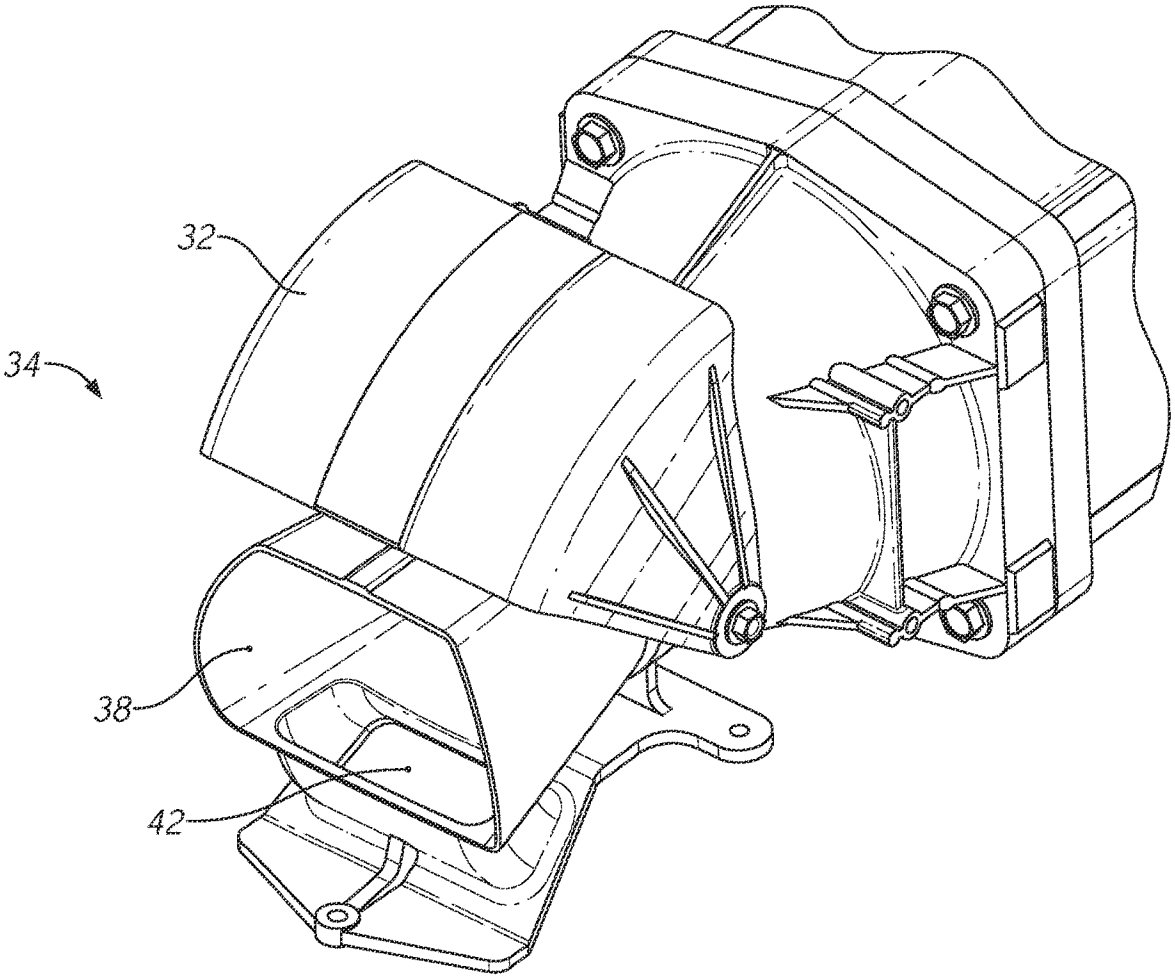
FIG. 3 (PRIOR ART)
FIG. 3 is a perspective view, showing a prior art deflector nozzle having a reverse gate.
Figure 4:
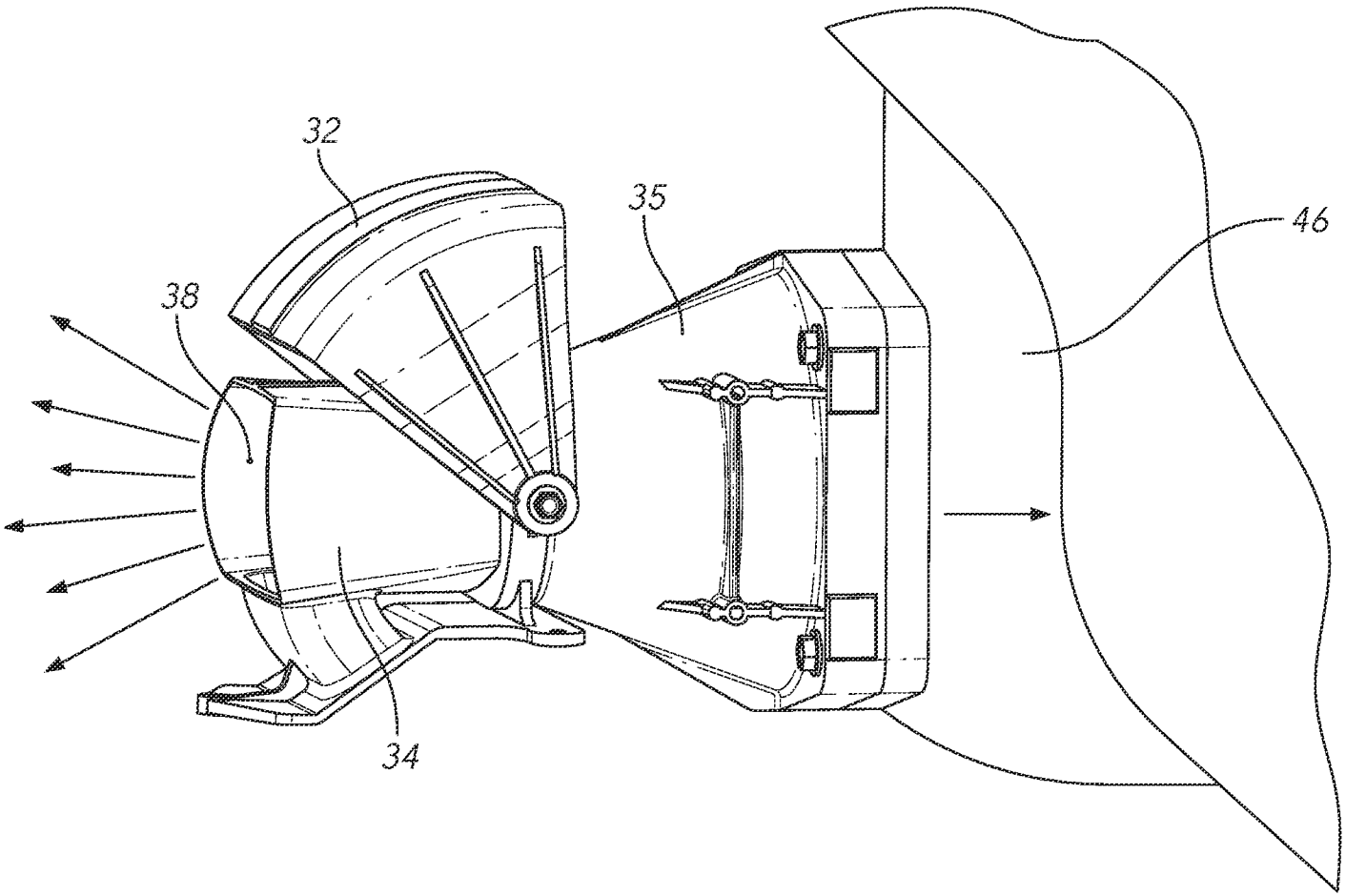
FIG. 4 (PRIOR ART)
FIG. 4 is a perspective view, showing a prior art deflector nozzle.
Figure 5:
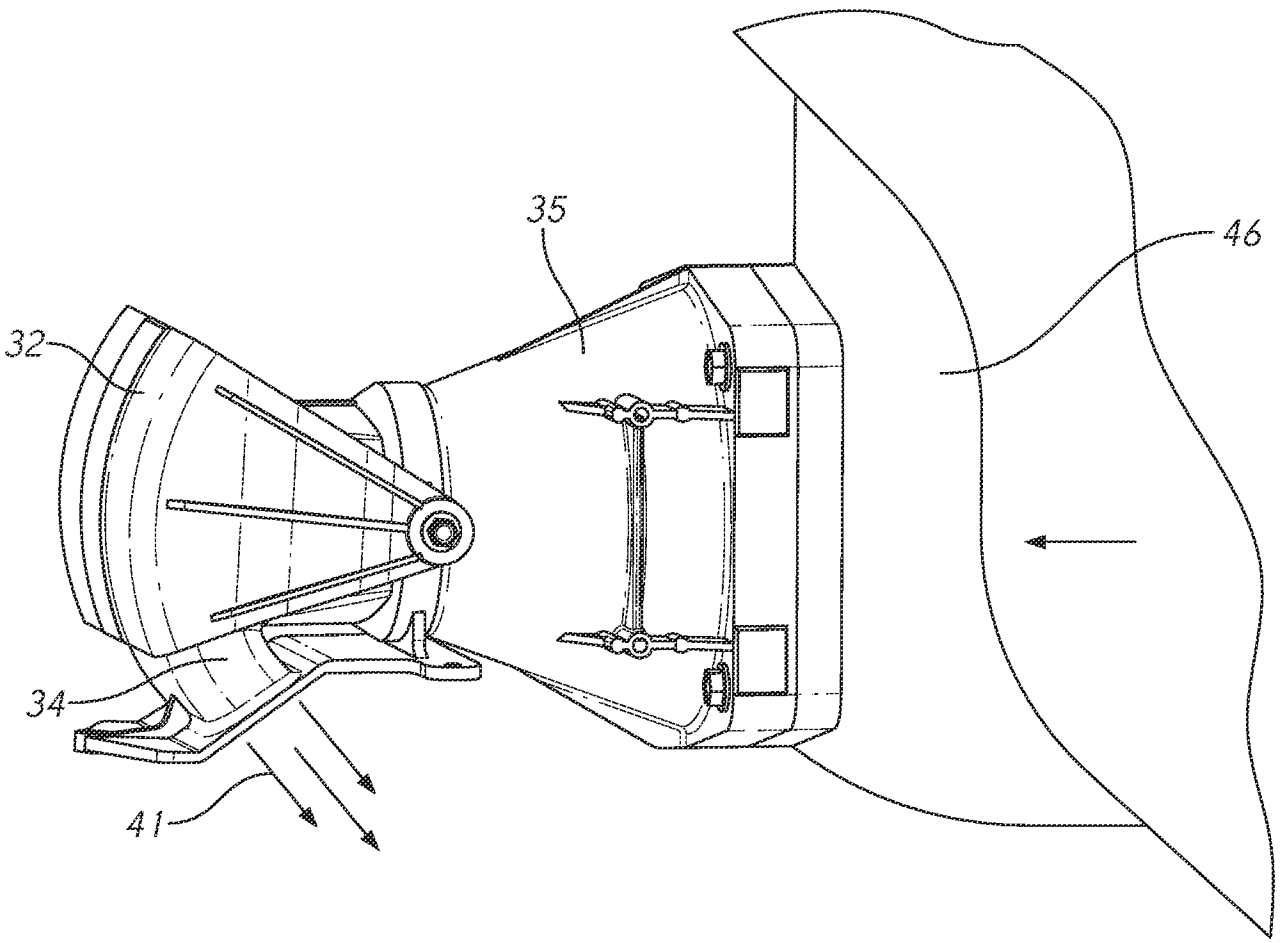
FIG. 5 (PRIOR ART)
FIG. 5 is a perspective view, showing a prior art deflector nozzle in reverse.
Figure 6:
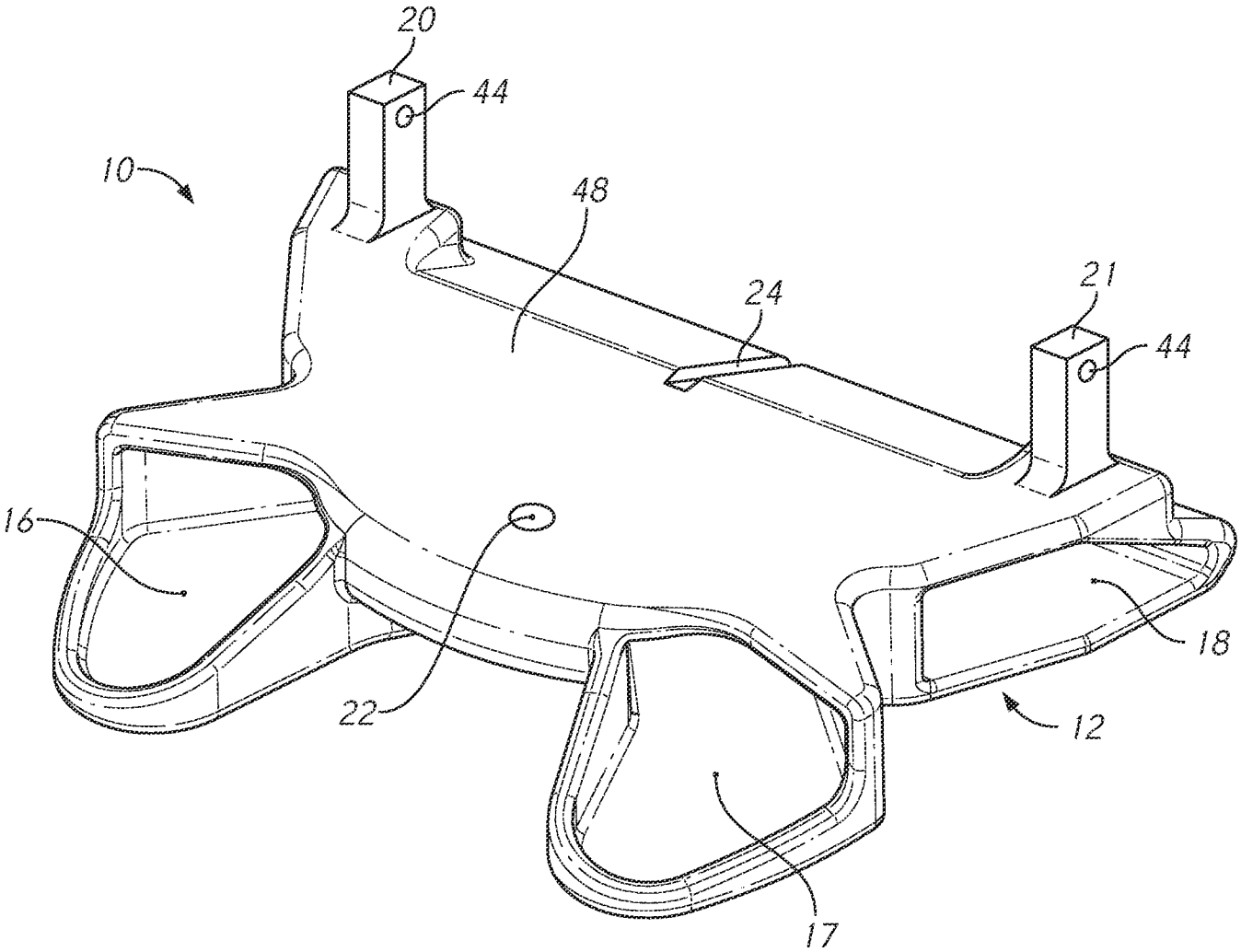
FIG. 6 is a perspective view, showing the present device.
Figure 7:
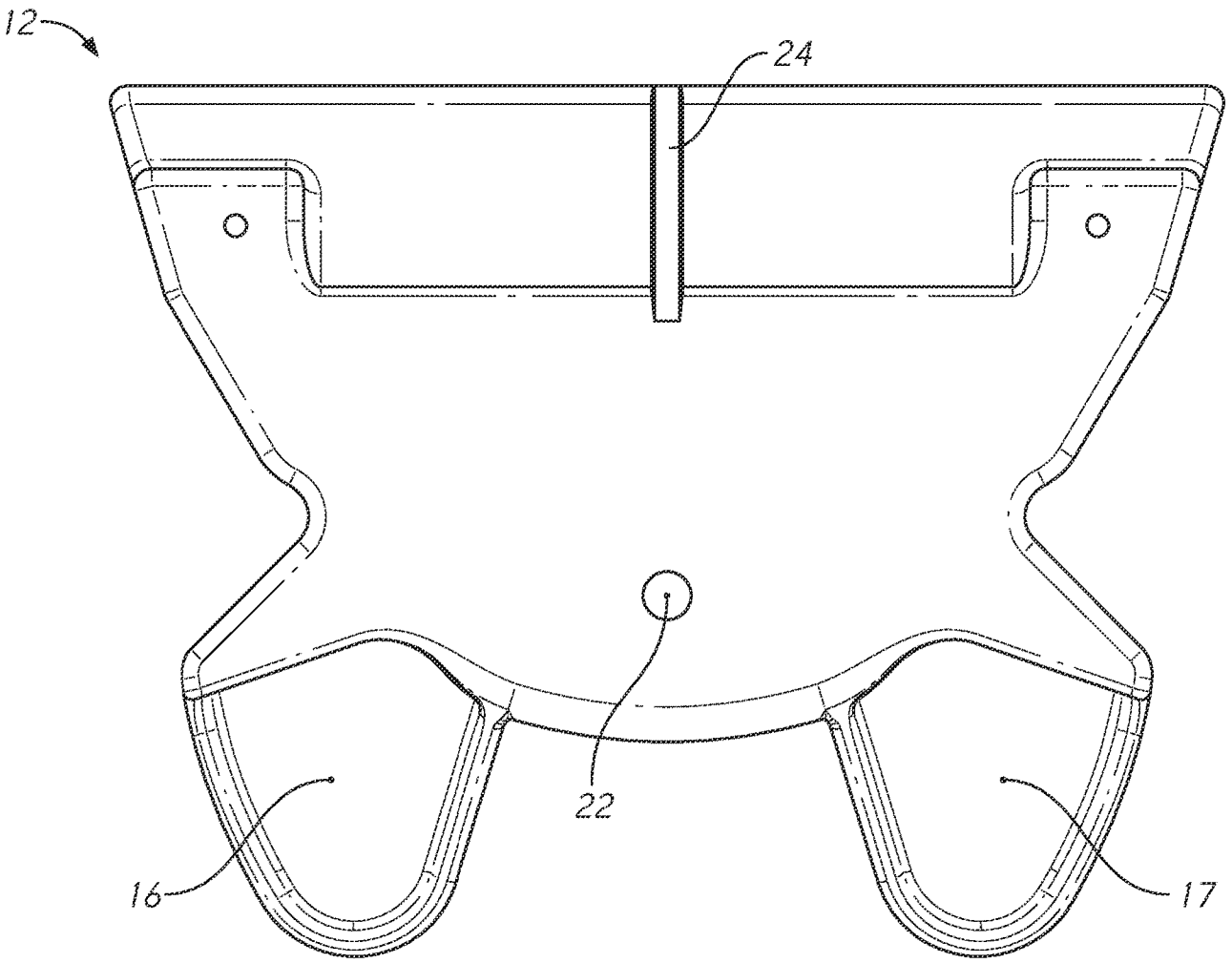
FIG. 7 is a top plan view, showing the present device.

10 device
12 main body
14 first channel
15 second channel
16 first inlet
17 second inlet
18 first outlet
19 second outlet
20 first attachment member
21 second attachment member
22 attachment point
23 first gate
24 bearing
25 second gate
26 impeller duct
27 impeller housing
28 pump assembly
30 watercraft
32 reverse gate
34 deflector nozzle
35 nozzle
36 steering wheel
38 first nozzle outlet
40 jet stream
41 first detent
42 spring void
43 second detent
44 fastener hole
45 gate attachment point
46 hull
48 first surface
49 base
50 outer wall
51 central area
52 centerline
54 first end
56 second end
58 inlet cross section point
60 outlet cross section point
64 degree of curvature
66 center of curvature
70 inlet center point
72 outlet center point
74 fastener
76 molded voids
78 base connection
80 first radius
82 second radius
86 molded raised portion
88 sidewall
90 center plane
91 spring
92 first end
93 second end
94 coil
95 cylinder
96 arm
97 post
98 gate void

DETAILED DESCRIPTION OF THE INVENTION

Figure 8:
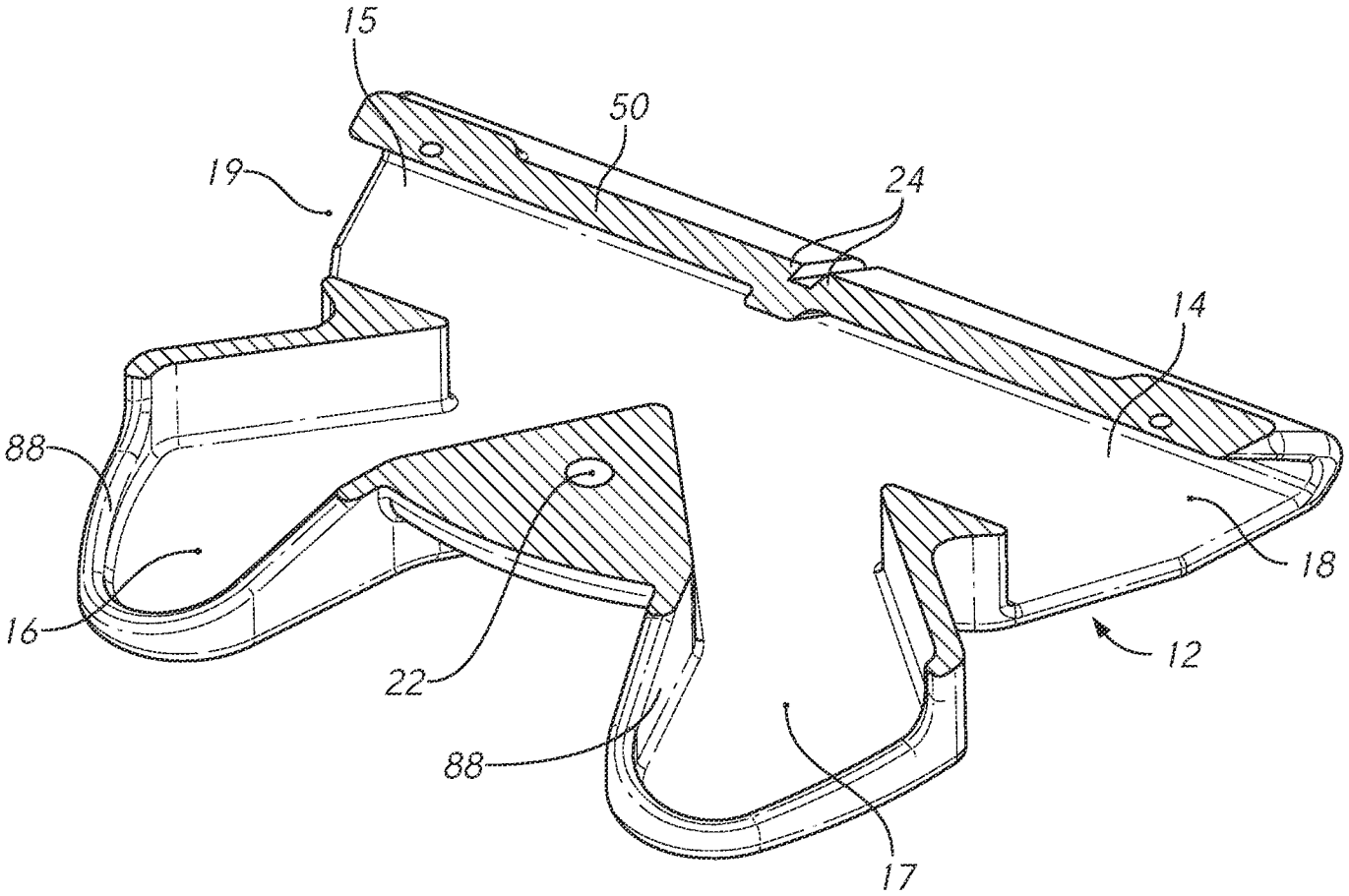
FIG. 8 is a cut-away view, showing a portion of the present device.
Figure 9:
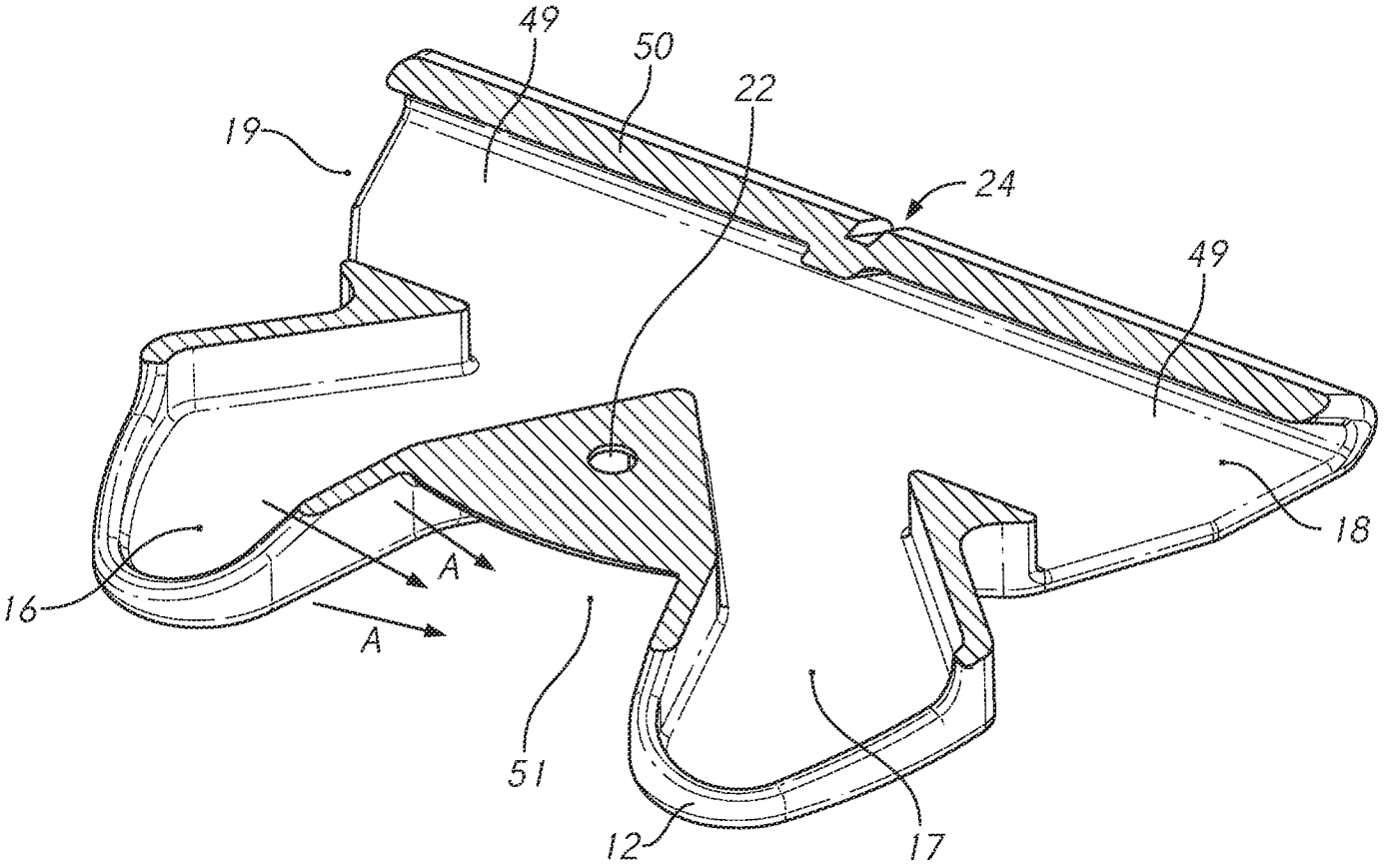
FIG. 9 is a cut-away view, showing a portion of the present device and the reverse flow.
Figure 10:
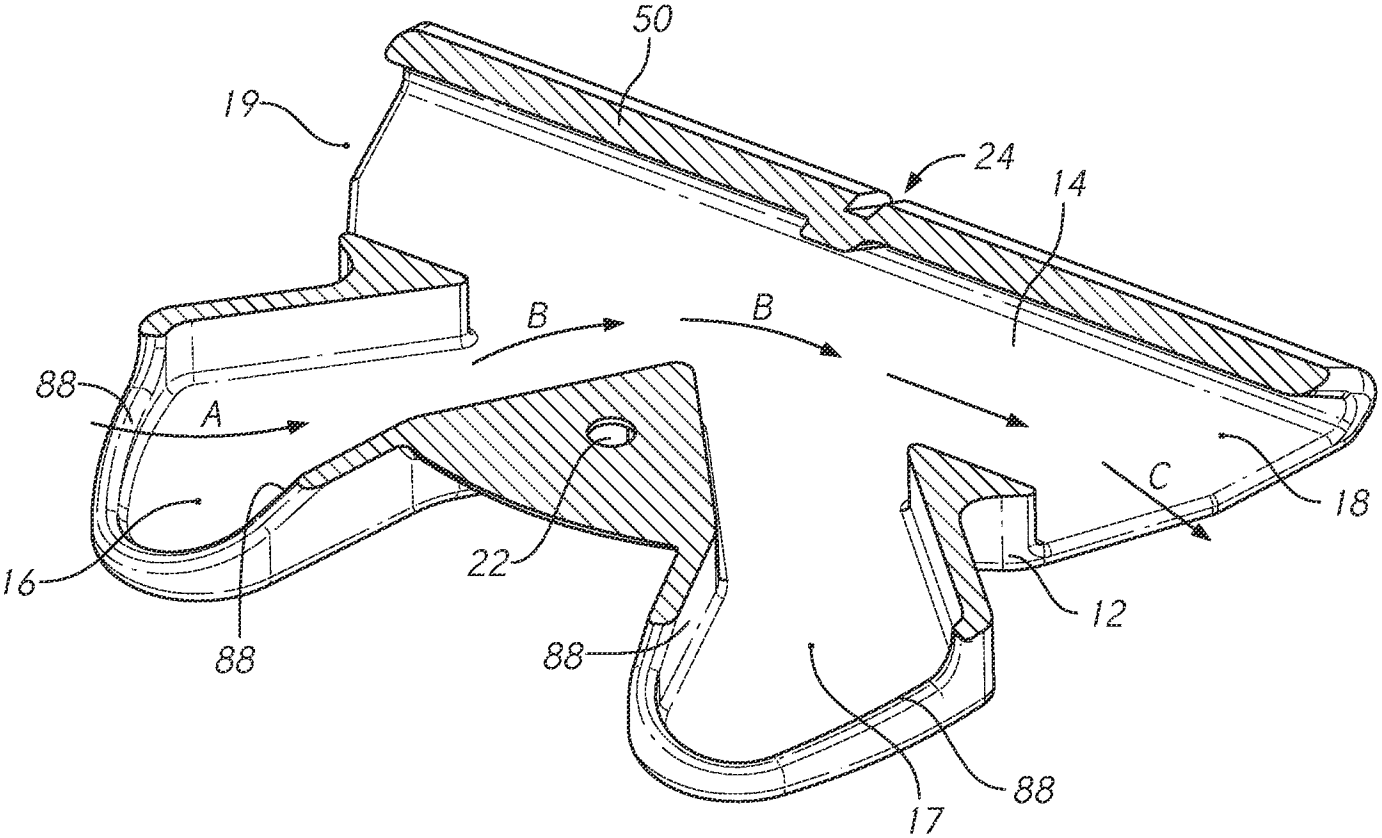
FIG. 10 is a cut-away view, showing a portion of the present device and the reverse flow.
Figure 11:
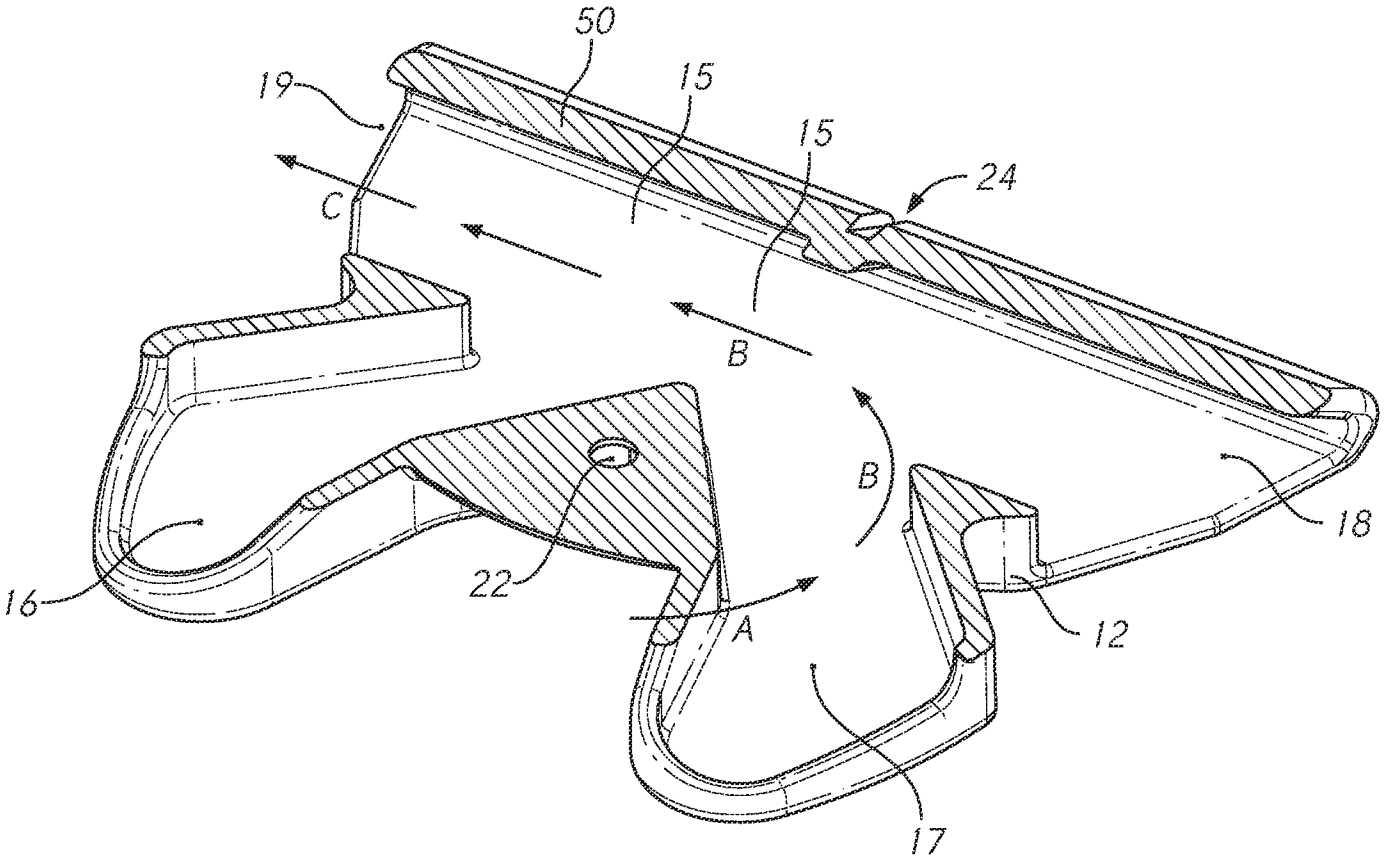
FIG. 11 is a cut-away view, showing a portion of the present device and the reverse flow, perspective view, showing the reverse jet stream flow through the present device.

FIG. 6-11 illustrate the present invention in the preferred embodiment. The device 10 redirects a portion of the reverse flow of a jet stream created by a watercraft. Main body 12 of device 10 has two interconnecting (or intersecting) channels 14, 15 disposed therein. First channel 14 fluidly connects inlet 16 to outlet 18, as shown in FIG. 10. Second channel 15 fluidly connects inlet 17 to outlet 19, as shown in FIG. 11. Device 10 is fixed to watercraft by bearing 24, attachment point 22 and attachment member 20, as further described herein. However, the reader will appreciate that any known method of fixing device 10 to watercraft can be used.

A view with the top surface of main body 12 cut away is shown in FIG. 8. Inlets 16, 17 and outlets 18, 19 are visible and are voids that permit entry and exit to channels 14, 15 within main body 12. Outer wall 50 and side walls 88 define channels 14, 15 (along with the top and bottom of main body 12). As described above, a portion of channels 14, 15 intersect with one another in the center of main body 12.

FIGS. 9-11 illustrate the reverse flow being acted upon by device 10. The views have the top surface of main body 12 cut away for clarity. FIG. 9 illustrates the reverse flow path when the watercraft is traveling in reverse and deflector nozzle is positioned at dead center of the watercraft. FIG. 9 shows that the reverse flow (shown as arrows 'A') enters central area 51 (formed between the portion of main body 12 that forms inlets 16, 17) because of the position of device 10 in relationship to the deflector nozzle (shown in FIG. 16). Reverse flow does not enter either inlet 16, 17 because of the position of device 10 in relationship to the deflector nozzle (shown in FIG. 16).

FIG. 10 shows the direction of reverse flow when deflector nozzle is toed toward the port side of the watercraft. Reverse flow enters inlet 16 in a downward and backward direction with respect to main body 12. The entry of reverse flow into inlet 16 is shown by arrow 'A'. Channel 14 is defined by side walls 88 (and top and bottom of main body 12) at inlet 16, which begins to redirect reverse flow. Although there is a gap within the channel 14 which leads to second outlet 19, the reverse flow is powerful enough that the flow continues in the direction of channel 14. Jet stream is ultimately redirected by channel 14 and primarily follows centerline 52 of channel 14, as shown in FIGS. 12 and 13.

Reverse flow is shown in FIG. 10 traveling through first channel 14. As the reverse flow of jet stream enters first inlet 16, first channel 14 bends reverse how and directs it towards first outlet 18 (bending of reverse flow is shown as arrows labeled "B"). First outlet 18 is located on (or formed within) main body 12. As the reverse flow is expelled through first outlet 18, the flow is primarily lateral (shown as arrows labeled "C"). The expulsion of lateral reverse flow through first outlet 18 provides a lateral thrust to watercraft.

FIG. 11 shows the direction of reverse flow when deflector nozzle is turned toward the starboard side of the watercraft. Reverse flow enters second inlet 17 in a downward and backward direction with respect to main body 12 (shown as arrow 'A'). As the reverse flow enters inlet 17, second channel 15 bends reverse flow and directs it toward second outlet 19 (shown as arrows labeled 'B'). As the reverse flow is expelled through second outlet 19, the flow is primarily lateral (shown as arrows labeled 'C'). The expulsion of lateral reverse flow through second outlet 19 provides a lateral thrust to watercraft.

Figure 12:
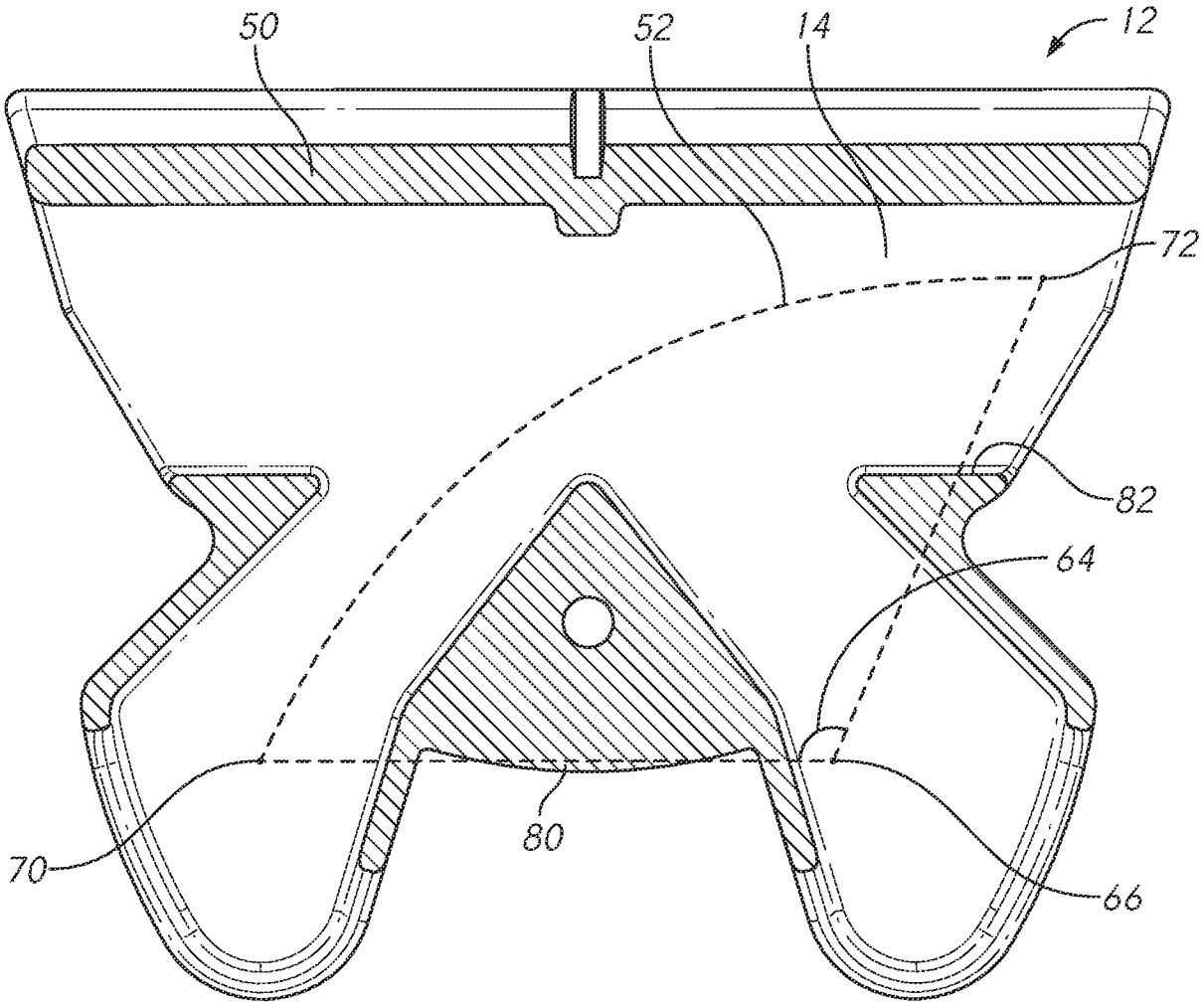
FIG. 12 is a schematic view, showing the geometry of the present device.
Figure 13:
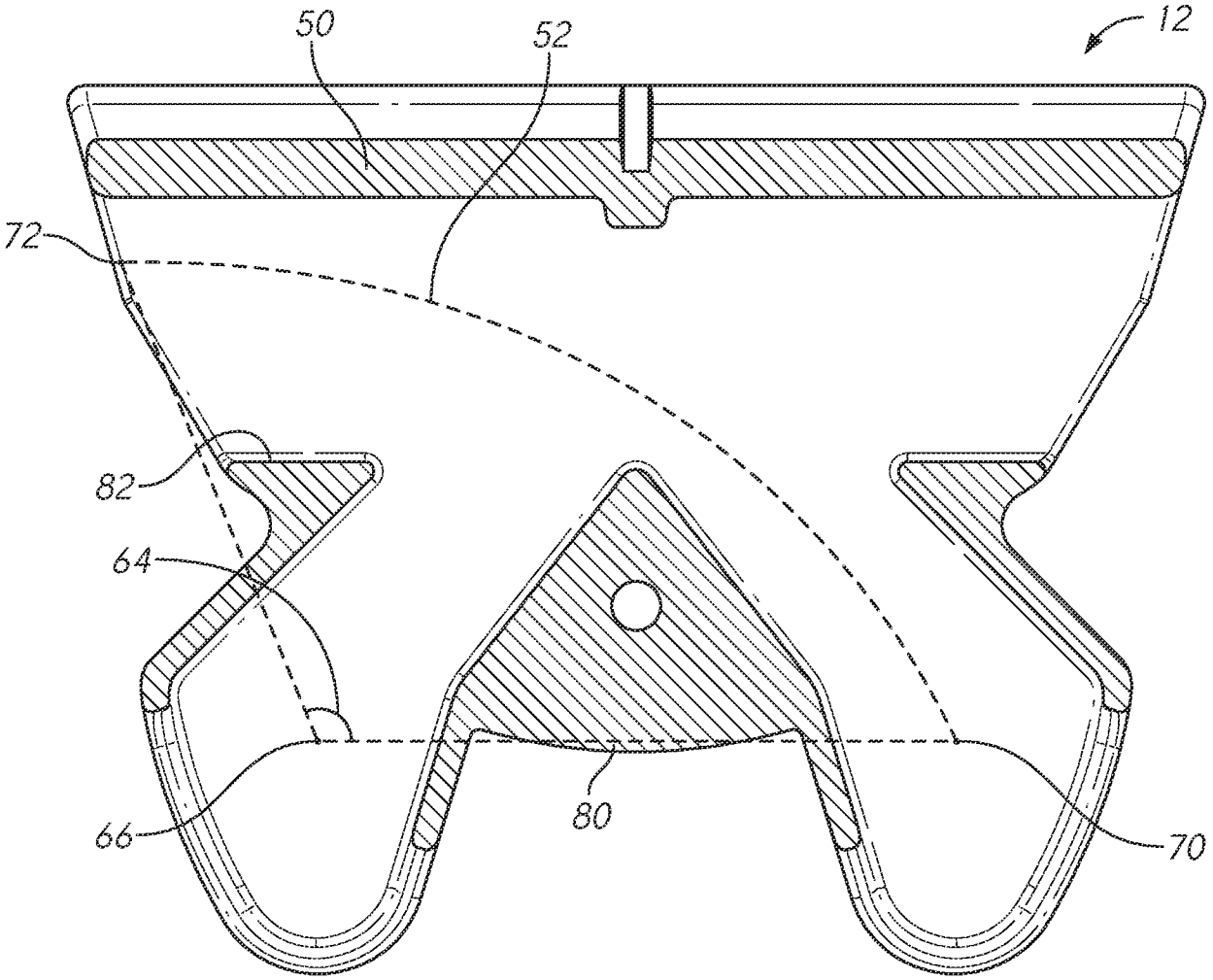
FIG. 13 is a schematic view, showing the geometry of the present device.

FIGS. 12 and 13 are schematic views of the geometry of the present device 10. First channel 14 and second channel 15 are defined by first inlet and second inlets, respectively (cross section points 70), outer wall 50 and the interior of main body 12 (side walls 88 and base). Each Inlet has a cross section with a center-point 70 and each outlet has a cross section with a center-point 74. Centerline 52 (of both first and second channel) is projected into a full circle (shown in broken lines). The center of curvature 66 (or center of circle) falls in the middle of the projected circle. Although the curves of centerline of each channel are not precise (each channel does not necessarily define a true curve—instead the term curve should be interpreted as a bend or turn), the reader will appreciate that a degree of curve 64 can still be measured by extrapolating the approximate curve into a circle. First radius 80 is measured from inlet center point 70 to center of curvature 66 for each channel. Second radius 82 is measured from outlet center point 74 to center of curvature 66 for each channel. The degree of centerline curve 84 is greater than 90 degrees.

Figure 14:
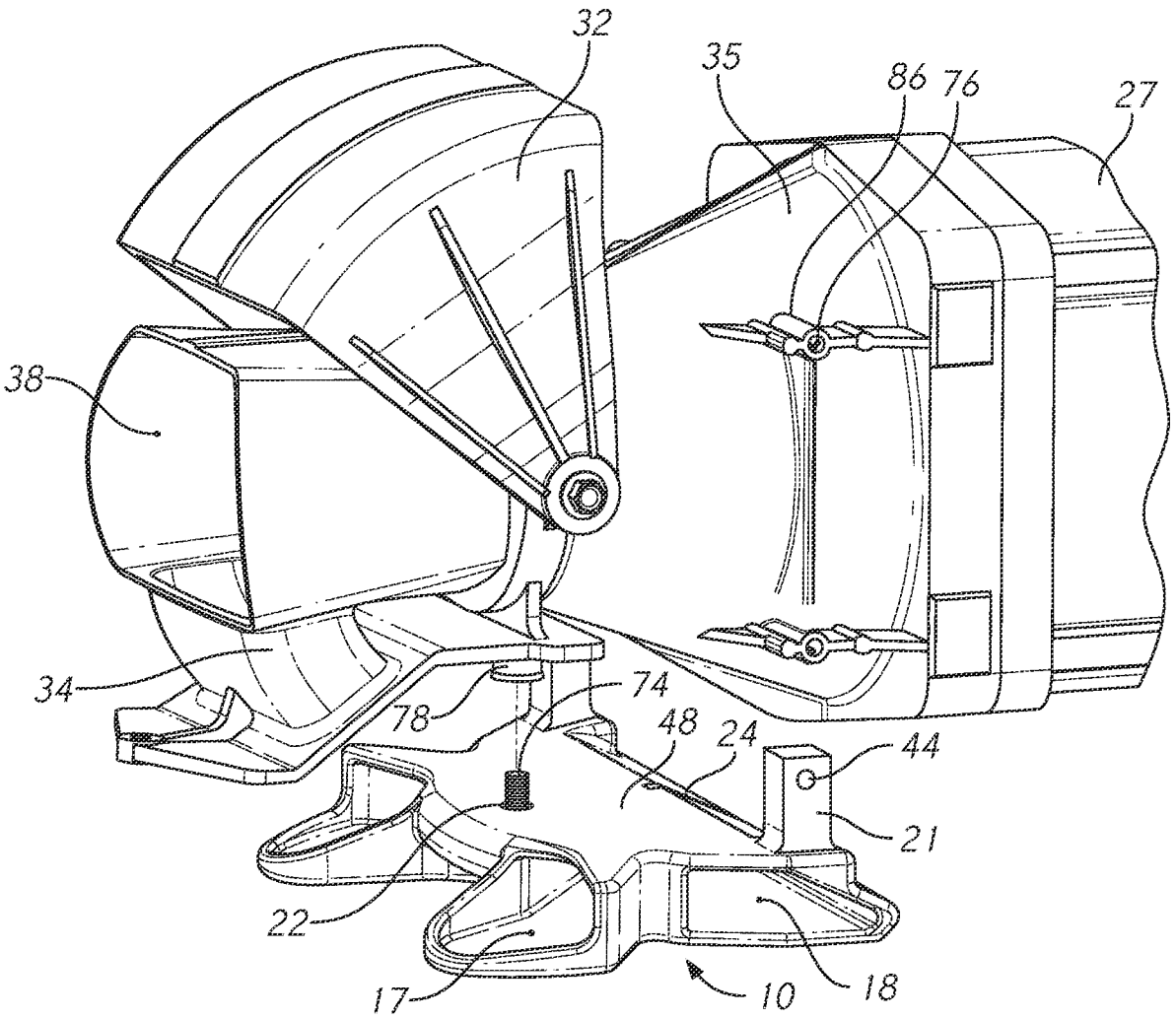
FIG. 14 is a perspective view, showing the present device aligned with prior art jet propulsion system.
Figure 15:
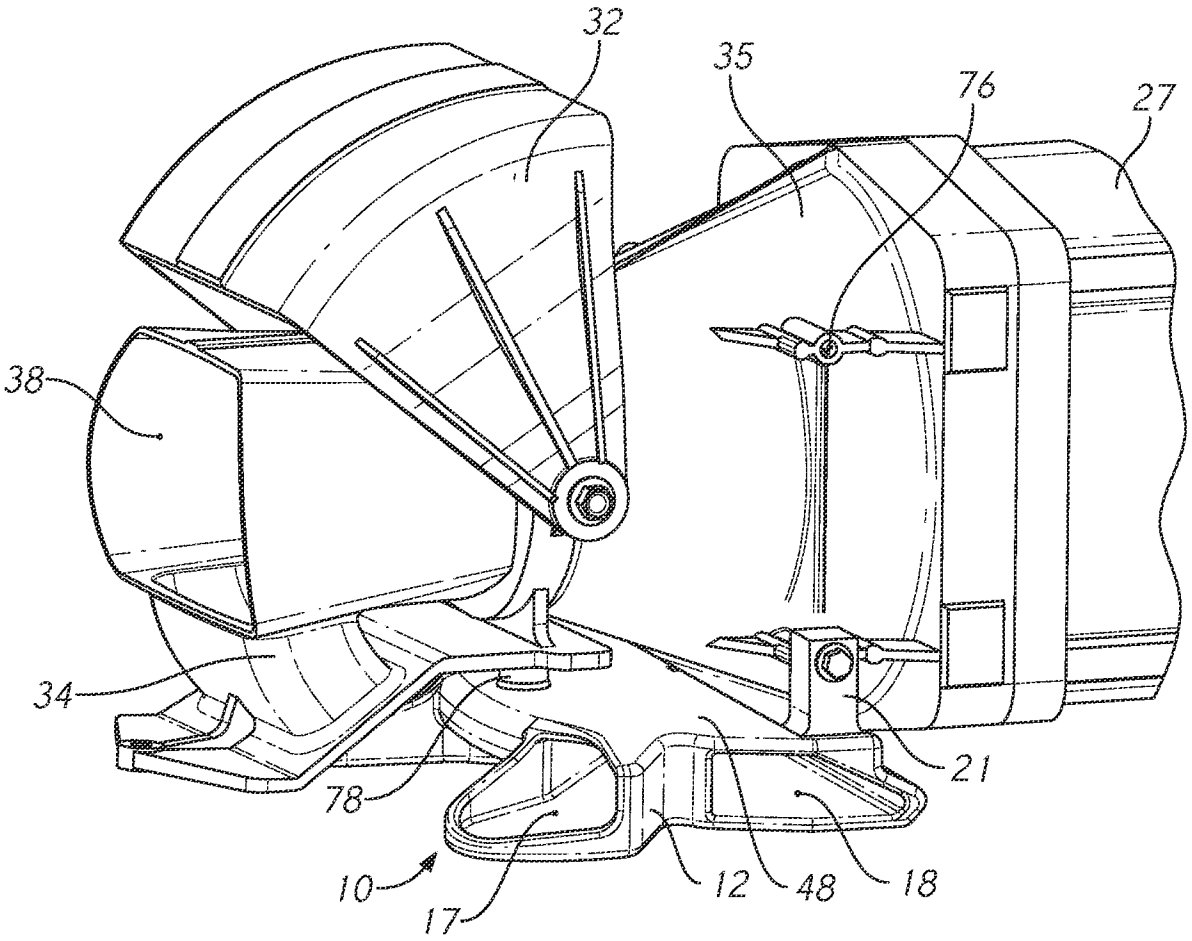
FIG. 15 is a perspective view, showing the present device attached to a prior art jet propulsion system.

FIGS. 14 and 15 are perspective views showing the present device 10 being attached to deflector nozzle 34 and pump 28. Main body 12 includes bearing 24 and attachment point 22. Attachment members 20, 21 are fixed to main body 12 (or could be fully integrated with main body 13). Bearing 24 includes a notch and two elevated walls. Bearing 24 surrounds either side of a molded raised portion 86 on the underside of pump 28. Molded raised portion 86 fits into notch and rests against bearing 24. The reader will appreciate that although bearing 24 is described as a notch and two elevated walls, bearing 24 can be formed by any known configuration that provides the necessary support. Beating 24 prevents device 10 from shifting left and right and assists in installation of device 10 by maintaining the device 10 square to the pump 28 during attachment. Attachment members 20, 21 extend upward from main body 12 and align with molded voids that accept fasteners (bolt or screw). Although two attachment members 20, 21 are shown on main body 12 (see FIG. 6), the device could only include one attachment member 20 and still be stable. Attachment point 22 aligns with base connection 78. Fastener 74 is threaded through attachment point 22 and into base connection 78. Device 10 is fixed in place beneath deflector nozzle 34 and does not rotate.

Although the device 10 is shown attached to deflector nozzle 34 and pump 28, the reader will appreciate that the present device 10 could be fixed to watercraft at any place and in any known manner. In the alternative, device 10 could be fully integrated with a directional nozzle, fixed mounted nozzle, impeller duct, impeller housing, the hull, ride plate or any other part of watercraft. The important aspect of the attachment of device 10 to watercraft is that inlets 16, 17 are positioned such that inlets 16, 17 accept a portion of jet stream from deflector nozzle 34, when deflector nozzle 34 is in a specific rotational position, as further described below.

Figure 16:
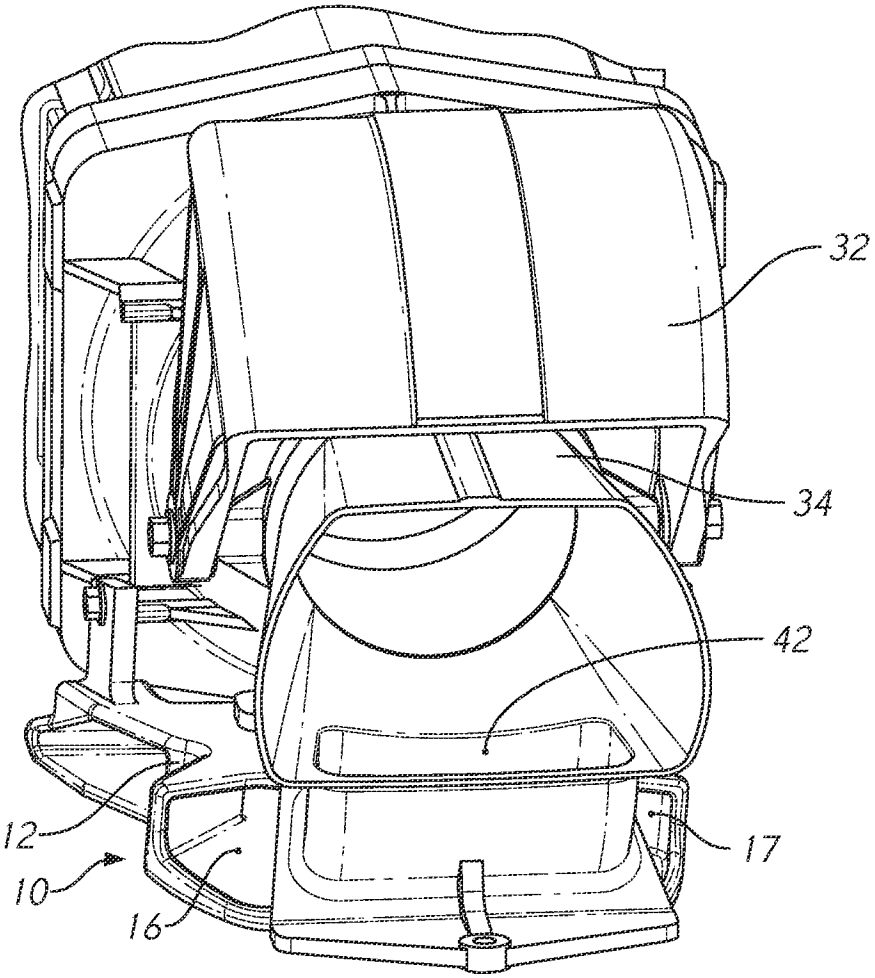
FIG. 16 is a perspective view, showing the present device attached to a prior art jet propulsion system.
Figure 17:
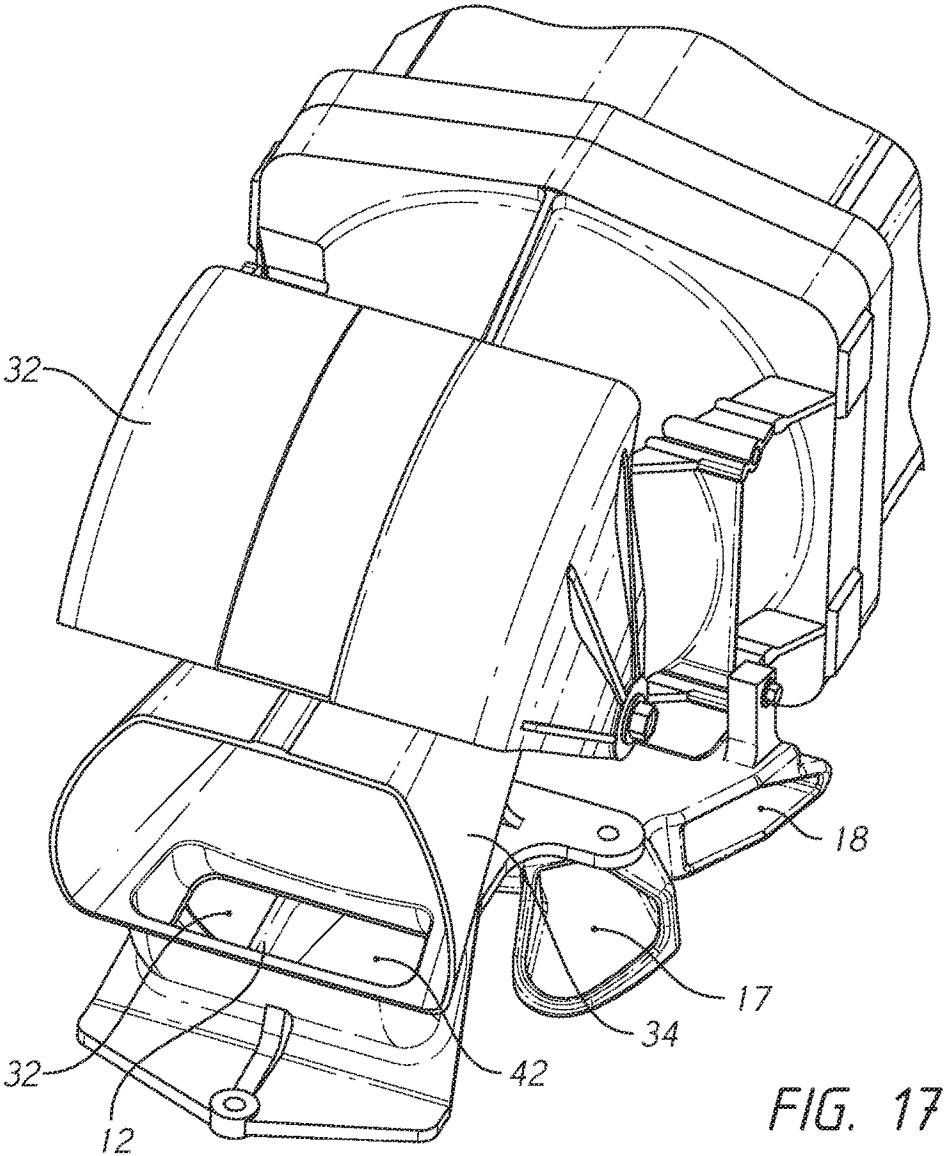
FIG. 17 is a perspective view, showing the present device attached to a prior art jet propulsion system.

FIGS. 16 and 17 show device 10 in position beneath deflector nozzle 34. For purpose of illustration, reverse gate 32 is shown in a raised position. However, reverse gate 32 would be lowered into the closed position to activate the reverse jet stream flow (and the present device 10). When deflector nozzle 34 is square to the watercraft (dead center), the reverse flow is not redirected by device 10. Reverse flow passes through center area 51 (shown in FIG. 9) in this position. As shown in FIG. 16, no portion of inlet 16 on main body 12 of device 10 is aligned with reverse nozzle outlet 42. Thus, when nozzle is dead center, reverse flow is not redirected causing unwanted lateral thrust. However, as shown in FIG. 17, when deflector nozzle 34 is fully rotated toward the port side of the watercraft, first inlet 16 is aligned with one side of reverse nozzle outlet 42. First inlet 16 spans approximately, but not limited to, one-third of reverse nozzle outlet 42. Thus, first inlet 16 redirects approximately, but not limited to, one-third of reverse jet stream when in operation. The lateral thrust provides more control over steering while operating the watercraft in reverse. It is important to note that as deflector nozzle 34 rotates, the area of first inlet 16 accepting reverse flow increases. Thus, lateral thrust slowly increases proportionately to the amount of water being forced into inlet 16. The operation is the same when the deflector nozzle 34 rotates toward the starboard side of the watercraft, except that second inlet 17 redirects reverse flow as opposed to first inlet 16. When in operation, the driver enjoys a precise level of control while in reverse. By varying the degree of rotation of the steering wheel the lateral thrust provided can be increased or decreased, thereby providing exceptional control input and confidence for the driver.

Figure 18C:
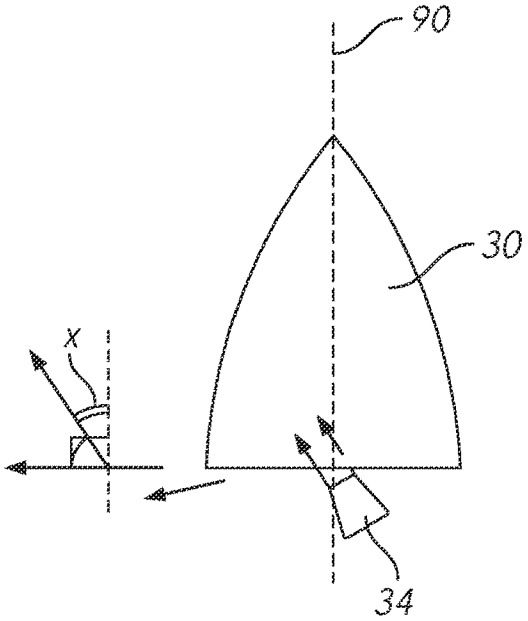
FIGS. 18B and 18C are schematic views, showing simplified depictions of reverse flow on a watercraft with present device attached thereto.
Figure 18B:
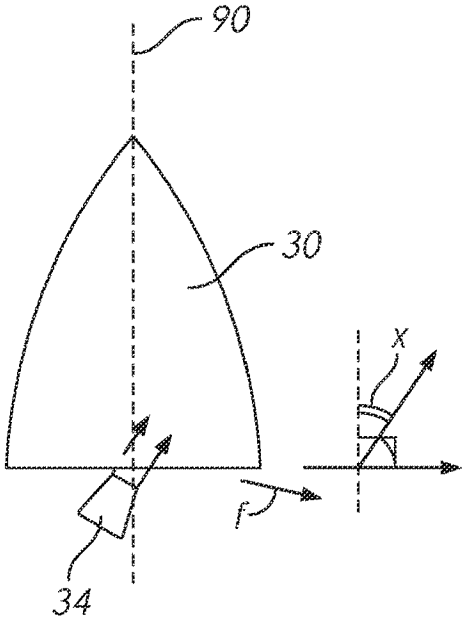
Figure 18A:
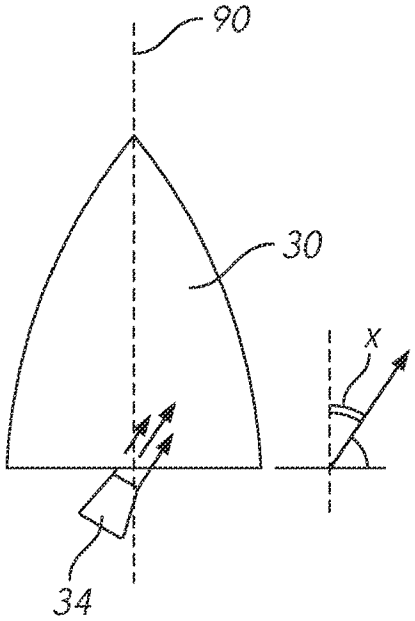
FIG. 18A (PRIOR ART)
FIG. 18A is a schematic view, showing a simplified depiction of reverse flow on a watercraft.

FIGS. 18A, 18B and 18C show schematic views of jet stream redirection while in reverse. FIG. 18A is a schematic view of a prior art system with a single engine. Deflector nozzle 34 in FIG. 18A is rotated toward the port side of the watercraft 30. When the reverse gate (shown in FIG. 1) is in a closed position, the jet stream (shown with arrows) is angularly displaced from the center plane of watercraft 90 by approximately 30 degrees (shown as angle x to the side of depiction of watercraft). FIG. 18B illustrates the jet stream redirection while in reverse with the present device employed. Again, deflector nozzle 34 is rotated toward the port side of watercraft 30. However, the deflector nozzle 34 is now aligned with first inlet 16 of device (such as shown in FIG. 17). A portion of the reverse flow is accepted into inlet and redirected through channel and expelled through outlet. The letter 'f' represents the redirected reverse flow exiting outlet on starboard deflector nozzle 34. As illustrated, only approximately one-third of the reverse flow from the starboard deflector nozzle 34 is redirected laterally. However, the redirection provides an efficient and functional lateral thrust capable of acting on the watercraft while in reverse. The redirected reverse flow 'f' is angularly displaced from the center plane of watercraft 90 by slightly greater than 90 degrees. The reader will appreciate that the angular displacement does not have to be greater than 90 degrees. Instead the angular displacement could be adjustable and/or greater than 45 degrees from center plane 90 of watercraft.

FIG. 18C illustrates the jet stream redirection while in reverse, with deflector nozzle 34 rotated toward the starboard side of watercraft 30. The port deflector nozzle 34 is now aligned with inlet of device (mirror image of FIG. 17). Again, the redirected reverse flow provides lateral thrust and is illustrated by the letter 'f' in FIG. 18C. The redirected reverse flow is angularly displaced from the center plane of watercraft 90 by slightly greater than 90 degrees. Again, only one-third of the total reverse flow from deflector nozzles 34 is redirected laterally through the device in the illustrated position.

Figure 19:
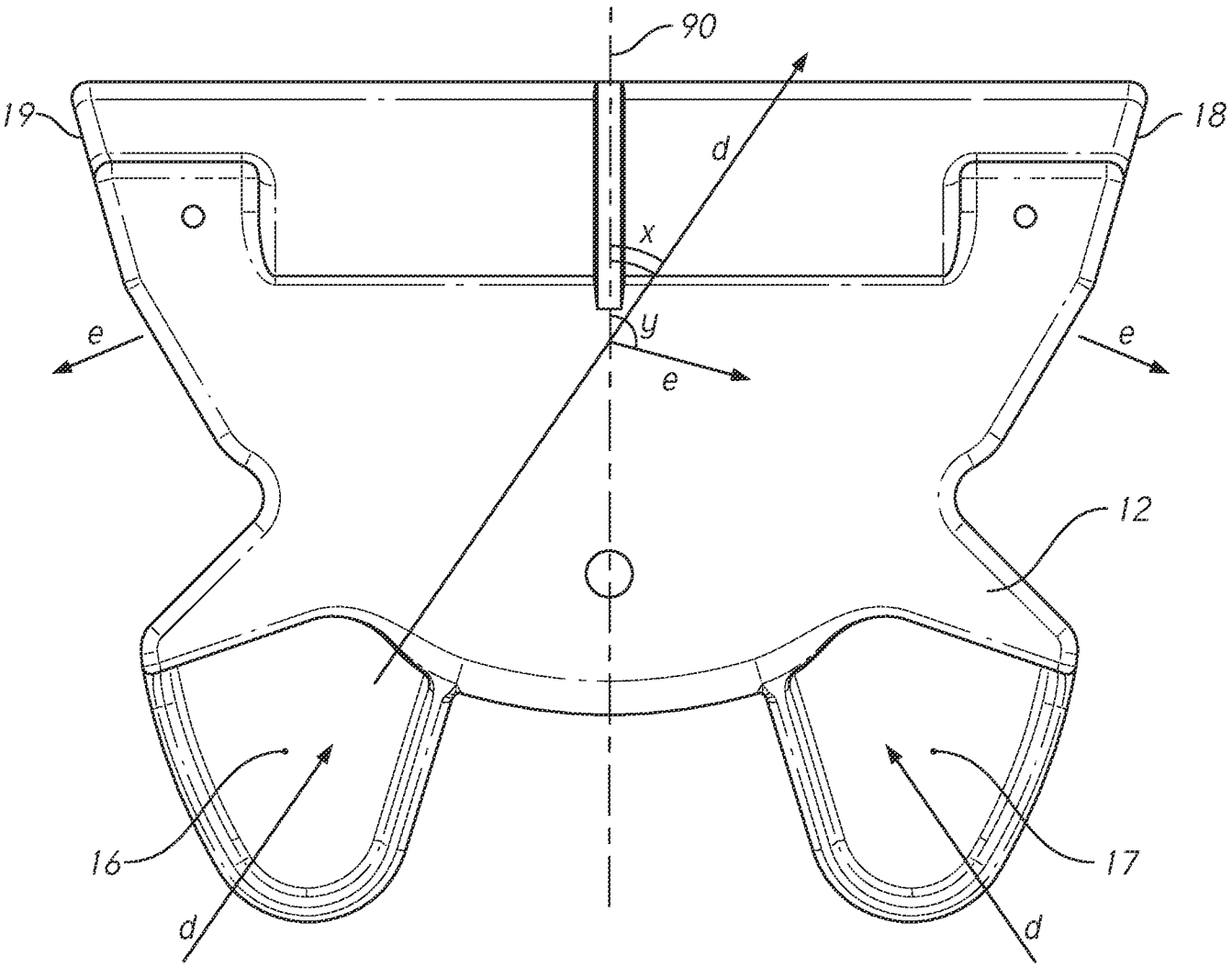
FIG. 19 is a schematic view, showing the angular displacement of reverse flow with respect to the present device and center plane of watercraft.
Figure 20:
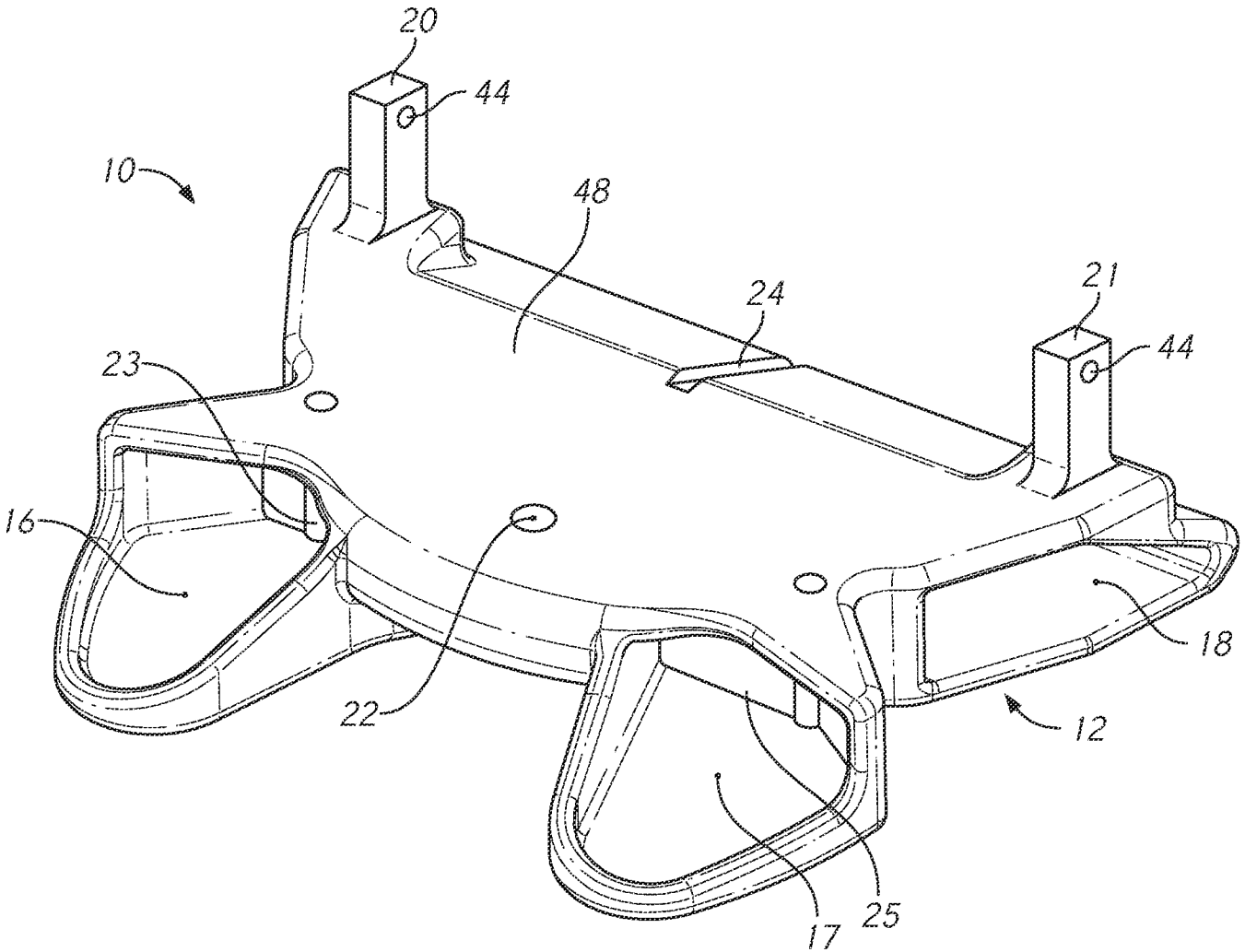
FIG. 20 is a perspective view, showing an alternate embodiment of the present invention.

FIG. 19 provides further illustration of the angular displacement of the reverse flow with respect to the center plane of watercraft 90. As water enters inlet 16, it is traveling in a downward and backward direction (shown as letter 'd') at approximately 30-degree displacement from center plane of watercraft 90 (angle of displacement shown as letter 'x'). First, and second channel (not shown) within main body 12 redirect the reverse flow laterally. Reverse flow exits outlet at slightly greater than 90-degree displacement from center plane of water-craft 90 (lateral flow shown as arrow 'e'). Angle of displacement shown as angle 'y'.

Figure 23:
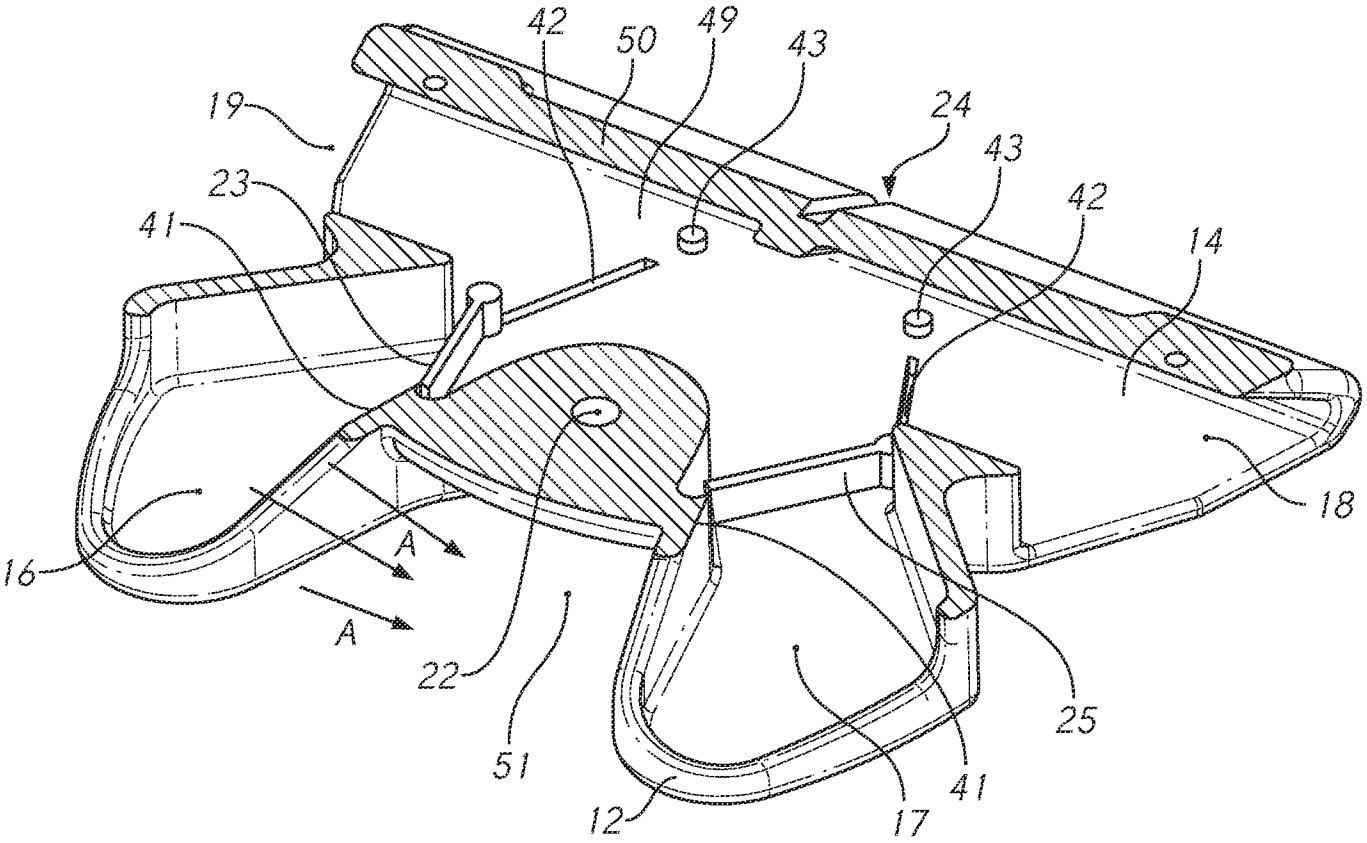
FIG. 23 is a cut-away view, showing a portion of an alternate embodiment of the present device and the reverse flow.
Figure 24:
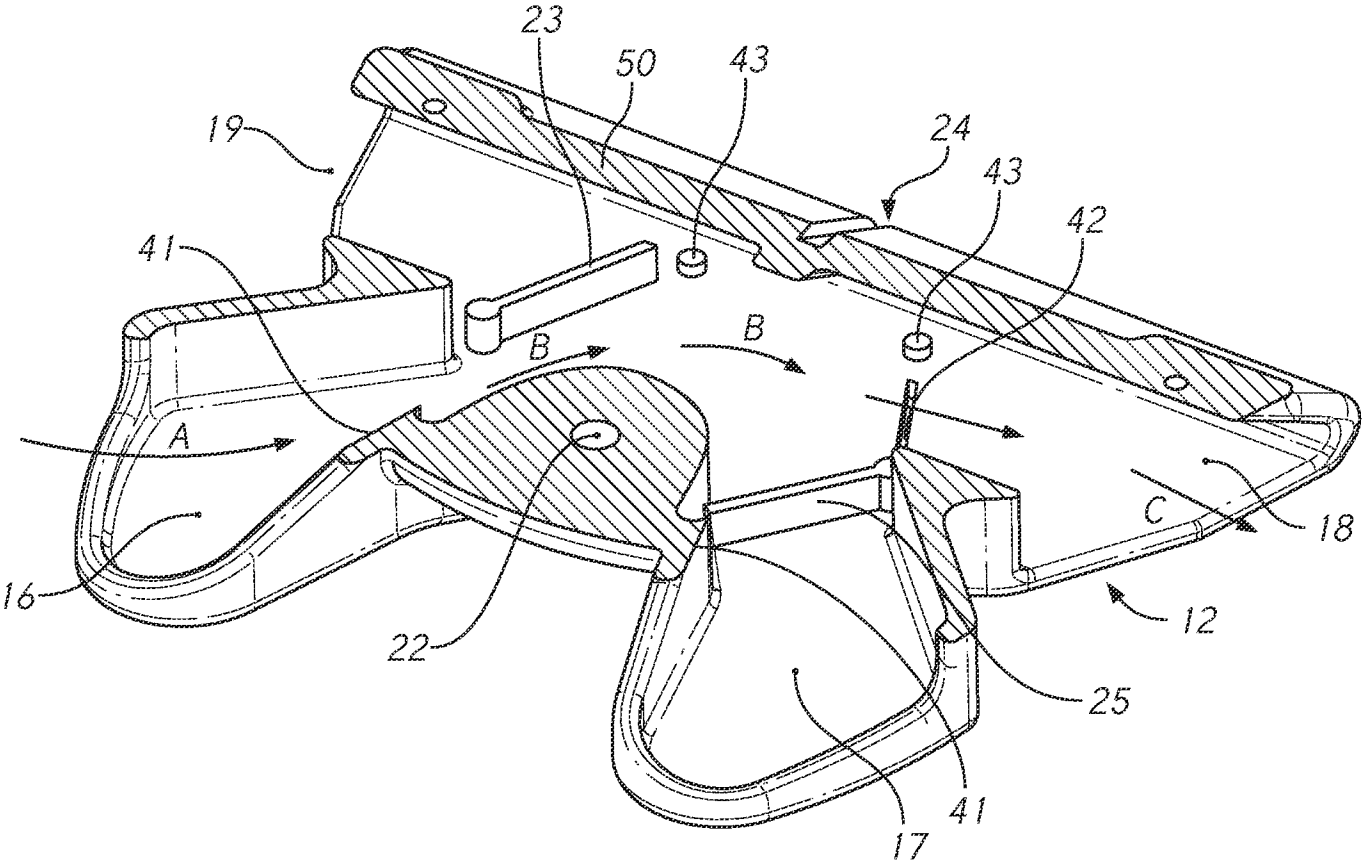
FIG. 24 is a cut-away view, showing a portion of an alternate embodiment of the present device and the reverse flow.
Figure 25:
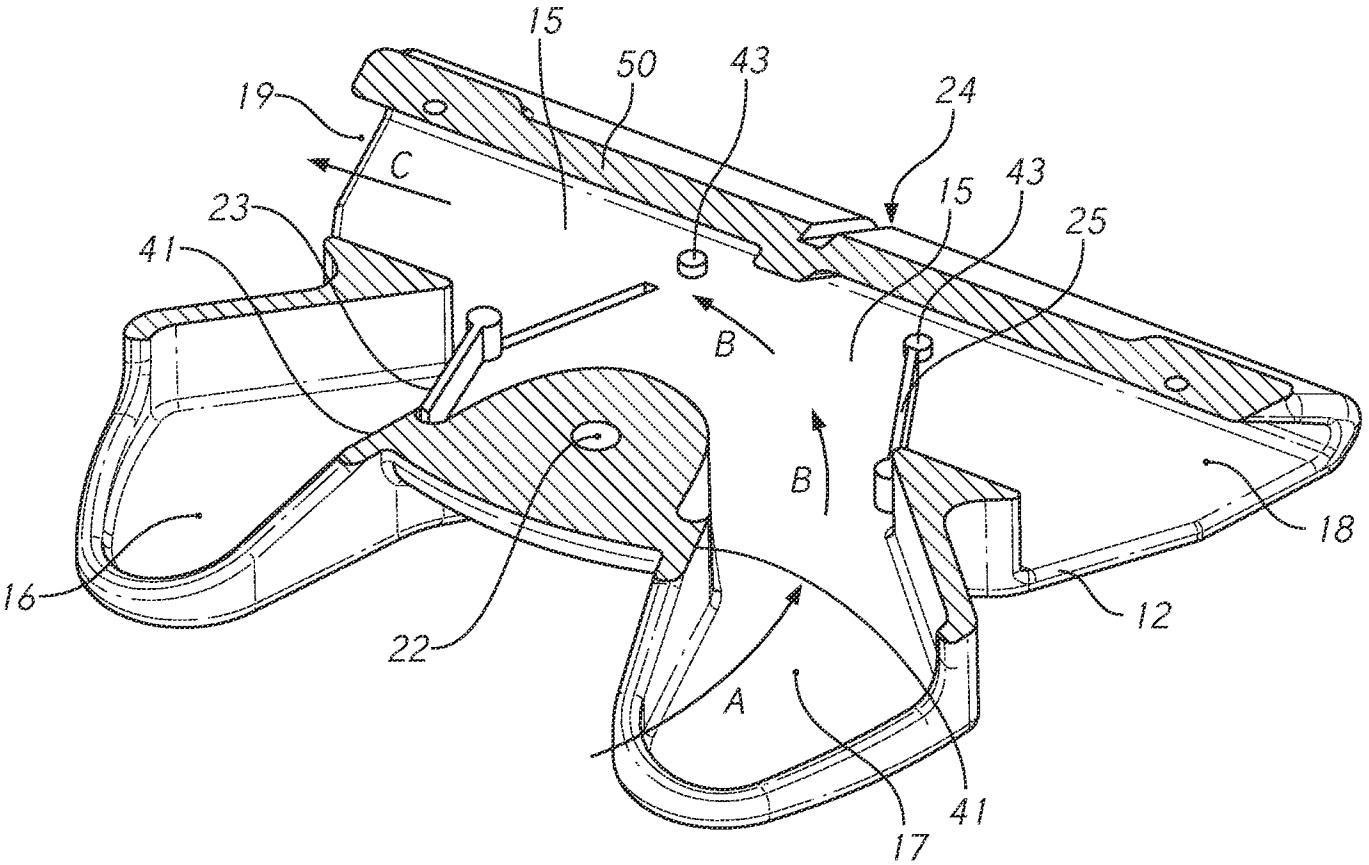
FIG. 25 is a cut-away view, showing a portion of an alternate embodiment of the present device and the reverse flow.

FIG. 20-25 illustrate a second embodiment of the present invention. Main body 12 still has two overlapping channels 14, 15 disposed therein. First channel 14 fluidly connects inlet 16 to outlet 18, as shown in FIG. 10. Second channel 15 fluidly connects inlet 17 to outlet 19, as shown in FIG. 11. However, as illustrated in FIGS. 24 and 25, additional gates are provided which aide directing a reverse flow through channels 14, 15.

Figure 21:
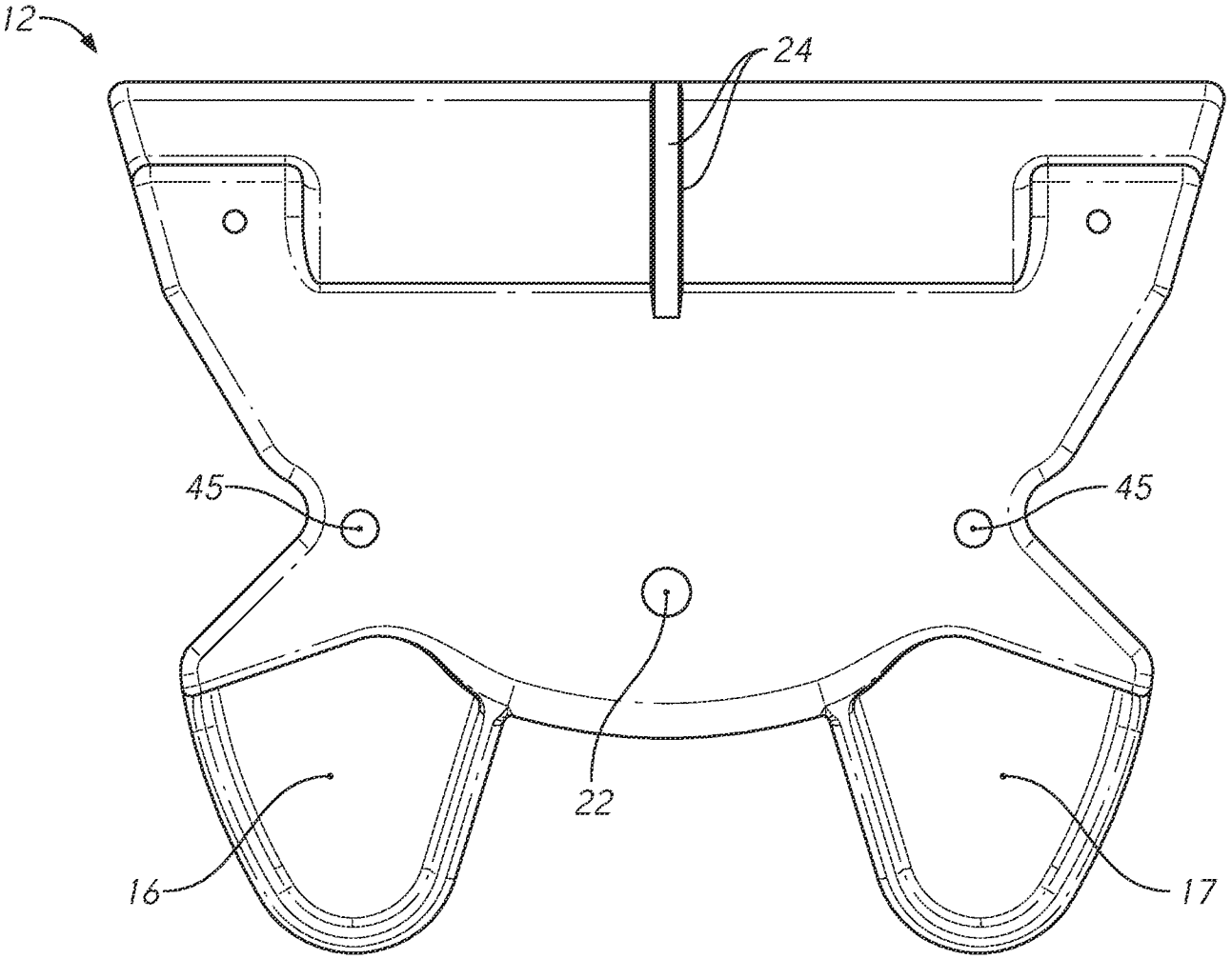
FIG. 21 is a top plan view, showing an alternate embodiment of the present device.
Figure 22:
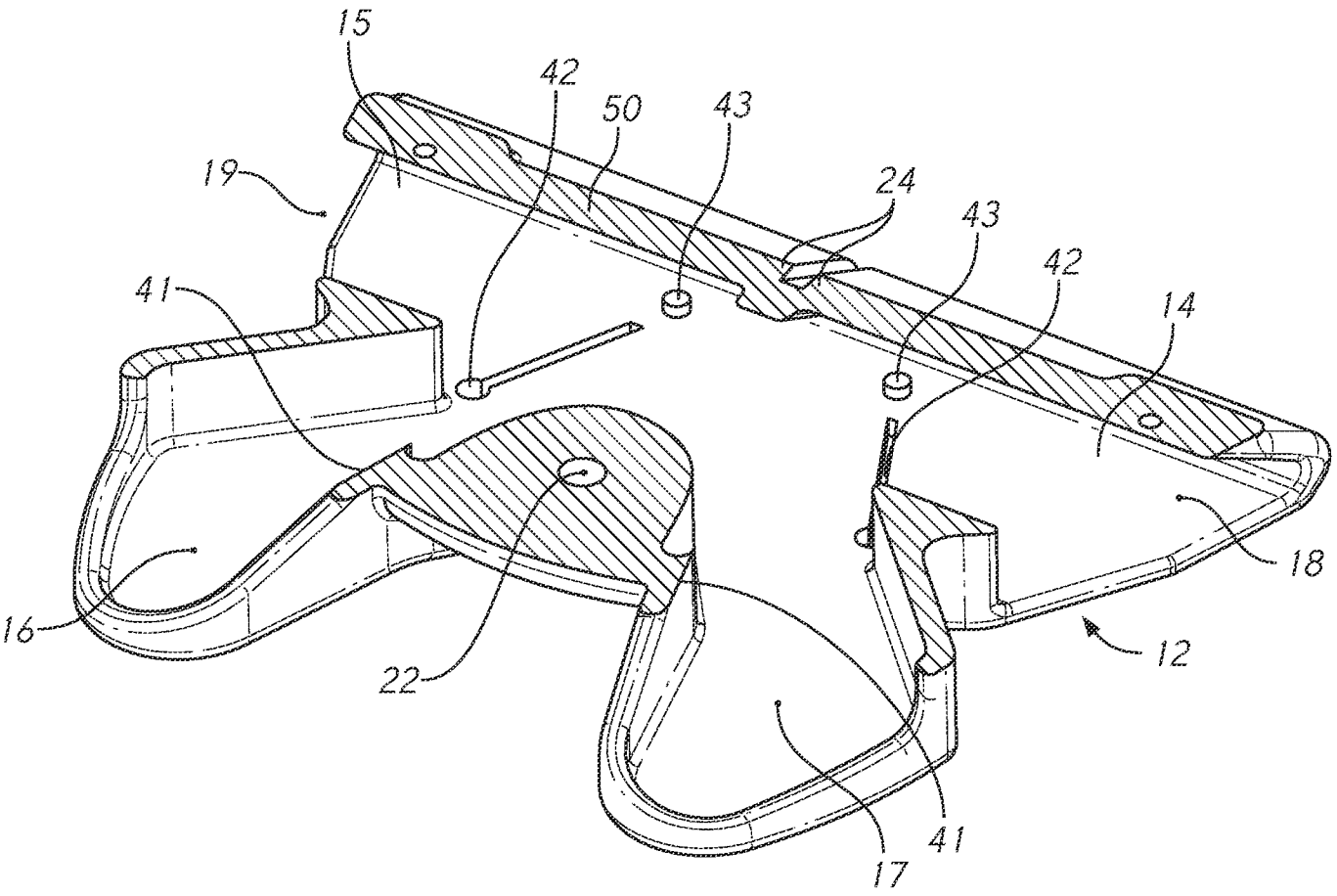
FIG. 22 is a cut-away view, showing a portion of an alternate embodiment of the present device.

A view with the top surface of main body 12 cutaway is shown in FIG. 21. Inlets 16, 17 and outlets 18, 19 are visible and are voids that permit entry and exit to channels 14, 15 within main body 12. Outer wall 50 defines the back wall of channels 14, 15. As described above, a portion of channels 14, 15 overlap one another in the center of main body 12. Two first detents 41 are formed by inner wall of main body 12 and sit proximate first and second inlet 16, 17, respectively. Two second detents 43 are proximate outer wall 50. Two spring voids 42 are formed within the base of main body 12. Although not visible, there are also two spring voids 42 in the interior top surface of main body 12. In operation torsion springs would attach voids to gates 23, 25 such that gates 23, 25 bear against first detents 41. The attachment and functionality of the spring voids 42 is further described herein.

FIGS. 23-25 illustrate the functionality of the device 10 as reverse flow acts upon device 10. FIG. 23 illustrates the position of gates 23, 25 when the watercraft is traveling in reverse and deflector nozzle is positioned at dead center of the watercraft. Reverse flow (shown as arrows 'A') enters central area 51 (formed between the portion of main body 12 that forms inlets 16, 17). Reverse flow does not enter either inlet 16, 17 because of the position of device 10 in relationship to the deflector nozzle (shown in FIG. 16). Each gate 23, 25 is kept in a closed position due to the force that torsion spring exerts upon gate 23, 25. First detents 41 prevent gates 23, 25 from hyper extension.

FIG. 24 shows the positioning of gates 23, 25 when deflector nozzle is turned toward the port side of the watercraft. As the reverse flow enters inlet 16, the flow overpowers the torsion force of spring (not shown) which drives first gate 23 open until it reaches second detent 43 (open position). When first gate 23 is in an open position and second gate 25 is closed, channel 14 is further defined. Second inlet 17 is not accepting reverse flow when the deflector nozzle is turned in this position therefore, second gate 25 remains in a closed position. Reverse flow enters inlet 16 in a downward and backward direction with respect to main body 12. The entry of reverse flow into inlet 16 is shown by arrow 'A'.

Reverse flow is shown traveling through first channel 14. As the reverse flow of jet stream enters first inlet 16, first channel 14 bends reverse flow and directs it towards first outlet 18 (bending of reverse flow is shown as arrows labeled "B"). First outlet 18 is located on (or formed within) main body 12. As the reverse flow is expelled through first outlet 18, the flow is primarily lateral (shown as arrows labeled "C"). The expulsion of lateral reverse flow through first outlet 18 provides a lateral thrust to watercraft.

FIG. 25 shows the position of gates 23, 25 when deflector nozzle is turned toward the starboard side of the watercraft. Reverse flow enters second inlet 17 and drives open second gate 25. First gate 23 remains closed and second channel 15 is further defined. Reverse flow enters second inlet 17 in a downward and backward direction with respect to main body 12 (shown as arrow 'A'). As the reverse flow enters inlet 17, second channel 15 bends reverse flow and directs it toward second outlet 19 (shown as arrows labeled 'B'). As the reverse flow is expelled through second outlet 19, the flow is primarily lateral (shown as arrows labeled 'C'). The expulsion of lateral reverse flow through second outlet 19 provides a lateral thrust to watercraft. The geometric properties of the turn (or approximate curve) of each channel 14, 15 remains the same as the original embodiment and is shown in FIGS. 12 and 13.

Figure 26:
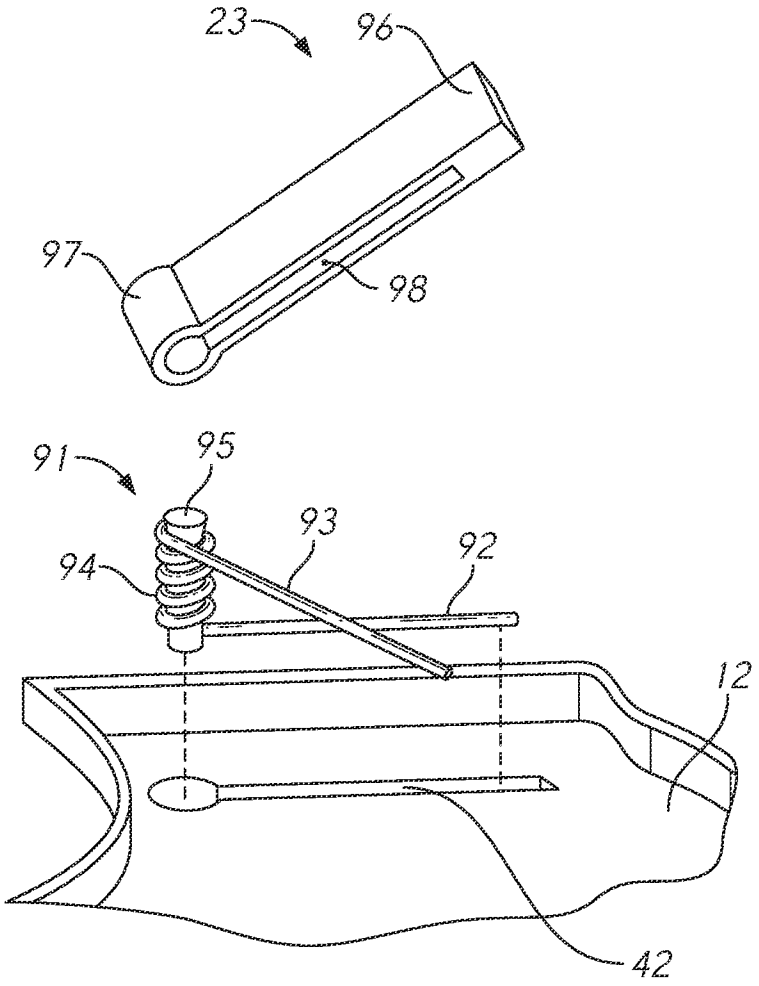
FIG. 26 is a cut away view, showing the attachment of a torsion spring to the present device.

FIG. 26 illustrates the operation of gates 23, 25 in connection with torsion spring 91. Each gate 23, 25 includes a post 97, arm 96 and gate void 98. Post remains in place as arm 96 pivots to close and open channels. Gate void 98 is located on the top and bottom of gates 23, 25. Gate void 98 can be any shape that allows spring 91 to connect to gate 23. For example, gate void 98 could be a small circular opening that allows second end 93 of spring to enter void vertically (preferably by shortening second end 93 and bending a part of second end 93 vertically upwards).

Torsion springs 91 are made up of a coil 94, first end 92 and second end 93. A cylinder 95 sits inside of coil 94. First end 92 of spring 91 (and the bottom part of cylinder 95 and coil 94), sits within spring void 42, which holds first end 92 of spring 91 in place within device. It is in this manner that the spring pre-loads and forces gate 23 towards inlet (not shown). However, first end 92 of spring 94 could be pre-loaded using sidewall 88 as opposed to base of main body 12 (as illustrated). Additionally, spring void 42 could be located at a different angle in base of main body 12 (allowing the user to adjust the preload of spring). A large portion of cylinder 95 and coil 94 are encased by post 97 of gates 23, 25. Spring 91 is preferably a torsion spring, which forces arm 96 of gates towards first or second inlet. The reader will appreciate that any known configuration of providing a force upon pivoting gates can be used.

The preceding description contains significant detail regarding the novel aspects of the present invention. It should not be construed, however, as limiting the scope of the invention but rather as providing illustrations of the preferred embodiments of the invention. As an example, device 10 can be fixed to underside of watercraft at jet propulsion system (pump) deflector nozzle, nozzle, impeller duct, impeller housing or device 10 can be fully integrated with watercraft ride plate (not shown) or hull. Additionally, device 10 and channels 14, 15 can be any shape such that redirection of reverse flow occurs as is described. Thus, the scope of the invention should be fixed by the following claims, rather than by the examples given.

We claim:

1. A device for redirecting a portion of the reverse flow of a jet stream created by a watercraft having a center plane, having a pump assembly, wherein said pump assembly has an impeller duct, an impeller housing, a nozzle and a deflector nozzle having a reverse gate pivotably connected to said nozzle, said device comprising:

a main body, fixed to said watercraft having a first channel and a second channel disposed therein;

wherein said first channel has an inlet and an outlet;

wherein said second channel has an inlet and an outlet;

wherein said first channel is configured to redirect said portion of said reverse flow of said jet stream when said deflector nozzle is in position over said inlet of said first channel;

wherein said second channel is configured to redirect said portion of said reverse flow of said jet stream when said deflector nozzle is in position over said inlet of said second channel;

wherein said portion of said reverse flow entering said inlet of said first channel is in a downward and backward direction with respect to said main body;

wherein said portion of said reverse flow entering said inlet of said second channel is in a downward and backward direction with respect to said main body;

wherein when said inlet of said first channel accepts said reverse flow, said first channel bends said reverse flow such that when said reverse flow exits said outlet said reverse flow is primarily a lateral flow and is angularly displaced from center plane of said watercraft by greater than 45 degrees; and wherein when said inlet of said second channel accepts said reverse flow, said second channel bends said reverse flow such that when said reverse flow exits said outlet said reverse flow is primarily a lateral flow and is angularly displaced from said center plane of said watercraft by greater than 45 degrees.

2. The device as recited in claim 1, wherein said inlet of said first channel and said inlet of said second channel are fixed to said watercraft proximate said deflector nozzle.

3. The device as recited in claim 2, wherein said inlet of said first channel and said inlet of said second channel are positioned to accept a portion of said reverse flow from said deflector nozzle, as said deflector nozzle pivots.

4. The device as recited in claim 3, wherein said first channel has a curve having a first end and a second end; and wherein said curve of said first channel have a degree of curve from said first end to said second end that is greater than 90 degrees.

5. The device as recited in claim 4, wherein said second channel has a curve having a first end and a second end; and wherein said curve of said second channel have a degree of curve from said first end to said second end that is greater than 90 degrees.

6. The device as recited in claim 1, further comprising:

a first attachment member and a second attachment member affixed to main body;

wherein said first attachment member and said second attachment member connect said device to said nozzle;

wherein said main body has an attachment point configured to attach beneath said deflector nozzle; and wherein said main body has a hearing including a notch and two elevated walls.

7. The device as recited in claim 1, wherein said reverse flow is angularly displaced from said center plane of said watercraft by greater than or equal to 90 degrees.

8. The device as recited in claim 1, wherein said inlet of said first channel and said second channel has an area and is fixed in place lower than said deflector nozzle; wherein as said deflector nozzle pivots toward one side or the other of said watercraft over said inlet of said first channel or said second channel said area of inlet of said first channel configured to accept said reverse flow increases.

9. The device as recited in claim 8, wherein said portion of said reverse flow redirected is a maximum of one-third of said reverse flow expelled from said deflector nozzle.

10. A device for redirecting a portion of the reverse flow of a jet stream created by a watercraft, having a pump assembly, wherein said pump assembly has an impeller duct, an impeller housing, a nozzle and a deflector nozzle having a reverse gate pivotably connected to said nozzle, said device comprising:

a main body, fixed to said watercraft, having a first inlet and a second inlet, a first outlet and a second outlet, and a first channel and a second channel disposed therein;

wherein said first channel fluidly connects said first inlet to said first outlet;

wherein said second channel fluidly connects said second inlet to said second outlet;

wherein said first inlet and said second inlet have an inlet cross section point and said first outlet and second outlet have an outlet cross section point;

wherein said first channel has a centerline which intersects with said first inlet cross section point and said first outlet cross section point;

wherein said second channel has a centerline which intersects with said second inlet cross section point and said second outlet cross section point;

wherein said centerline of said first channel has a degree of curve from said first inlet cross section to said first outlet cross section of greater than or equal to 90 degrees; and wherein said centerline of said second channel has a degree of curve from said second inlet cross section to said second outlet cross section of greater than or equal to 90 degrees.

11. The device as recited in claim 10, further comprising:

a first attachment member and a second attachment member affixed to main body; and wherein said first and second attachment members connect said device to said nozzle.

12. The device as recited in claim 10, wherein said main body has an attachment point configured to attach beneath said deflector nozzle.

13. The device as recited in claim 12, wherein said main body has a bearing including a notch and two elevated walls.

14. The device as recited in claim 10, wherein said first inlet has an area and is fixed in place beneath said deflector nozzle; and wherein as said deflector nozzle pivots toward one side of said watercraft over said first inlet, said area of first inlet configured to accept said reverse how increases.

15. The device as recited in claim 14, wherein said second inlet has an area and is fixed in place beneath said deflector nozzle; and wherein as said deflector nozzle pivots toward one side of said watercraft over said second inlet, said area of said second inlet configured to accept said reverse flow increases.

16. The device as recited in claim 15, wherein said portion of said reverse flow redirected is a maximum of one-third of said reverse flow expelled from said deflector nozzle.

17. A device for redirecting a portion of the reverse flow of a jet stream created by a watercraft having a first and a second engine, wherein said first and second engine each have a pump assembly, wherein said pump assembly has an impeller duct, an impeller housing, a nozzle and a first and second deflector nozzle having a reverse gate pivotably connected to said nozzle, said device comprising:

a main body, fixed to said watercraft proximate said first deflector nozzle of said engine, having a first inlet and second inlet, a first outlet and a second outlet, and a first channel and second channel disposed therein;

wherein said first channel fluidly connects said first inlet to a first outlet;

wherein said second channel fluidly connects said second inlet to said second outlet;

wherein said first channel and said second channel intersect;

wherein said first channel is configured to redirect said portion of said reverse flow of said jet stream when said deflector nozzle is in position over said first inlet;

wherein when said first inlet of said first channel accepts said reverse flow, said first channel bends said reverse flow such that when said reverse flow exits said first outlet said reverse flow is primarily a lateral flow;

wherein said second channel is configured to redirect said portion of said reverse flow of said jet stream when said deflector nozzle is in position over said second inlet; and wherein when said second inlet of said second channel accepts said reverse flow, said second channel bends said reverse flow such that when said reverse flow exits said second outlet said reverse flow is primarily a lateral flow.

18. The device as recited in claim 17, wherein said first inlet and said second inlet have an area; wherein said first inlet and said second inlet are fixed in place beneath said deflector nozzle such that as said deflector nozzle pivots towards the port side of said watercraft, said area of first inlet configured to accept said reverse flow increases and as said deflector nozzle pivots toward the starboard side of said watercraft, said area of said second inlet configured to accept said reverse flow increases.

19. The device as recited in claim 18, wherein said portion of said reverse flow redirected is a maximum of one-third of said reverse flow expelled from said deflector nozzle.

* * * * *